US008587917B2

(12) United States Patent
Fujita

(10) Patent No.: US 8,587,917 B2
(45) Date of Patent: Nov. 19, 2013

(54) STATIC ELIMINATOR AND STATIC ELIMINATION CONTROL METHOD

(75) Inventor: Tsukasa Fujita, Osaka (JP)

(73) Assignee: Keyence Corporation, Osaka (JP)

( * ) Notice: Subject to any disclaimer, the term of this patent is extended or adjusted under 35 U.S.C. 154(b) by 0 days.

(21) Appl. No.: 13/438,204

(22) Filed: Apr. 3, 2012

(65) Prior Publication Data

US 2012/0257318 A1 Oct. 11, 2012

(30) Foreign Application Priority Data

Apr. 8, 2011 (JP) ..... 2011-086781

(51) Int. Cl.
*H01T 23/00* (2006.01)

(52) U.S. Cl.
USPC ..... 361/231

(58) Field of Classification Search
USPC ..... 361/230, 231
See application file for complete search history.

(56) References Cited

U.S. PATENT DOCUMENTS

| | | | | |
|---|---|---|---|---|
| 4,423,462 | A * | 12/1983 | Antonevich | 361/235 |
| 4,630,167 | A | 12/1986 | Huggins | |
| 4,757,422 | A | 7/1988 | Bossard et al. | |
| 4,872,083 | A | 10/1989 | Blitshteyn | |
| 5,017,876 | A * | 5/1991 | Wright et al. | 324/464 |
| 6,653,638 | B2 | 11/2003 | Fujii | |
| 6,744,617 | B2 | 6/2004 | Fujii | |
| 7,324,322 | B2 | 1/2008 | Fujita et al. | |
| 7,375,944 | B2 | 5/2008 | Izaki et al. | |
| 2008/0130190 | A1 | 6/2008 | Shimada | |
| 2008/0151465 | A1 | 6/2008 | Fujita et al. | |
| 2009/0168288 | A1 | 7/2009 | Hashimoto | |
| 2009/0168289 | A1 | 7/2009 | Shimada et al. | |
| 2010/0044581 | A1 | 2/2010 | Fujita et al. | |
| 2012/0257318 | A1 * | 10/2012 | Fujita | 361/212 |

FOREIGN PATENT DOCUMENTS

| | | |
|---|---|---|
| JP | S63-143954 | 6/1988 |
| JP | 03-266398 | 11/1991 |
| JP | 04-308694 | 10/1992 |
| JP | 08-078183 | 3/1996 |
| JP | 08-298197 | 11/1996 |
| JP | 2008-135329 | 6/2008 |
| JP | 4219451 B2 | 2/2009 |
| JP | 4367580 B2 | 11/2009 |

* cited by examiner

*Primary Examiner* — Ronald W Leja
(74) *Attorney, Agent, or Firm* — Kilyk & Bowersox, P.L.L.C.

(57) ABSTRACT

Provided is a static eliminator capable of holding ion balance uniform regardless of a distance from the static eliminator. The static eliminator includes: an electrode driving device that alternately and repeatedly applies, to a discharge electrode, a positive drive voltage and a negative drive voltage as drive voltages for corona discharge; decreases a ratio of the application time of the positive drive voltage while relatively increasing the voltage value of the positive drive voltage in a case of increasing positive ions, and increases the ratio of the application time of the positive drive voltage while relatively decreasing the voltage value of the positive drive voltage in a case of increasing negative ions.

5 Claims, 15 Drawing Sheets

CASE OF $T_a < T_b$

CASE OF $T_a = T_b$

CASE OF $T_a > T_b$

STATIC ELIMINATOR AND STATIC ELIMINATION CONTROL METHOD

CROSS-REFERENCE TO RELATED APPLICATIONS

The present application claims foreign priority based on Japanese Patent Application No. 2011-086781, filed Apr. 8, 2011, the contents of which is incorporated herein by reference.

BACKGROUND OF THE INVENTION

1. Field of the Invention

The present invention relates to a static eliminator and a static elimination control method, and more specifically to improvement in static eliminator where a drive voltage for corona discharge is repeatedly applied to a discharge electrode, to generate positive ions and negative ions on a periphery of the discharge electrode.

2. Description of Related Art

The static eliminator is a device that supplies positive ions or negative ions to a workpiece charged with static electricity or the like, thereby to remove extra electricity from the workpiece. Static eliminators, which make use of corona discharge that occurs at a tip of a discharging electrode needle at the time of application of a high voltage for drive to the electrode needle, can be grouped into a DC system, an AC system, a pulse DC system, a pulse AC system, and some other type in terms of a drive system at the time of application of the drive voltage to the discharge electrode. In the DC system, a positive-side electrode with a positive potential held with respect to a ground/earth and a negative-side electrode with a negative potential held therewith are provided as discharge electrodes. In the AC system, an AC voltage is applied to a single discharge electrode. In the pulse DC system, a pulse-like drive voltage is alternately applied to a positive-side electrode and a negative-side electrode. In the pulse AC system, a pulse-like AC voltage is applied to a single discharge electrode.

Normally, whether a static elimination object is charged positive or charged negative cannot be seen, and hence it is necessary to generate both positive ions and negative ions. Further, in order to prevent static electricity from remaining on the static elimination object at the time of completion of static elimination, it is necessary to generate the positive ions and the negative ions only in equal amount. However, voltage characteristics of currents flowing through the discharge electrode due to corona discharge in the positive polarity and the negative polarity are not symmetrical (e.g., U.S. Pat. No. 4,872,083). For example, a lower limit of a drive voltage required for corona discharge is lower in the negative polarity. Thereat, in the conventional static eliminator, drive control for the discharge electrode is performed such that positive discharge and negative discharge evenly occur (e.g., Japanese Unexamined Patent Publication No. H8-298197, Japanese Patent No. 4367580, Japanese Unexamined Patent Publication No. 2008-135329, Japanese Patent No. 4219451). Japanese Unexamined Patent Publication No. H8-298197 discloses an AC-system static eliminator, with a discharge electrode applied with a positive DC bias. Japanese Unexamined Patent Publication No. H8-297197 describes adjustment of the DC bias based on an output of an ion sensor.

Japanese Patent No. 4367580 discloses a pulse DC-system static eliminator, which adjusts a ratio between an application time of a positive drive voltage to be applied to the positive-side electrode and an application time of a negative drive voltage to be applied to the negative-side electrode, while holding a drive cycle constant, thereby to adjust ion balance. Japanese Unexamined Patent Publication No. 2008-135329 discloses a pulse AC-type static eliminator, which adjusts respective voltage values of a positive drive voltage and a negative drive voltage, while making an application time of the positive drive voltage remain in agreement with an application time of the negative drive voltage, thereby to adjust ion balance. Further, in Japanese Patent No. 4219451, a ratio between an application time of a positive drive voltage and an application time of a negative drive voltage is adjusted while a drive cycle is held constant, thereby to adjust ion balance.

In the conventional static eliminators described above, it is known that the ion balance changes in accordance with a distance from the static eliminator. Thus, there has been a problem in that, even when the ion balance can be made zero at a specific distance from the static eliminator, the ion balance in the vicinity of the static eliminator significantly deteriorates.

SUMMARY OF THE INVENTION

It is an object of the present invention to provide a static eliminator and a static elimination control method which are capable of improving distance characteristics for ion balance.

In particular, it is an object to provide a static eliminator capable of holding ion balance uniform regardless of the distance from the static eliminator, while being capable of respectively generating positive ions and negative ions in desired amounts. Further, it is an object to provide a static eliminator capable of suppressing deterioration in ion balance in the vicinity of the static eliminator.

A static eliminator according to one embodiment of the present invention includes an electrode driving device that alternately and repeatedly applies, to a discharge electrode, a positive drive voltage and a negative drive voltage as drive voltages for corona discharge, a voltage value adjusting device that adjusts at least one of a voltage value of the positive drive voltage and a voltage value of the negative drive voltage, an application time adjusting device that adjusts at least one of an application time of the positive drive voltage and an application time of the negative drive voltage, and a drive controlling device that controls an adjustment amount of the voltage value and an adjustment amount of the application time, wherein the drive controlling device decreases a ratio of the application time of the positive drive voltage while relatively increasing the voltage value of the positive drive voltage in a case of increasing positive ions, and increases the ratio of the application time of the positive drive voltage while relatively decreasing the voltage value of the positive drive voltage in a case of increasing negative ions.

With such a configuration, while the voltage value of the drive voltage with the same polarity as ions to be increased is increased or the voltage value of the drive voltage with the reverse polarity is decreased, the ratio of the application time of the drive voltage with the same polarity is decreased, and it is thereby possible to hold constant an average potential of the discharge electrode for a time longer than a repeated interval of the drive voltage. This allows suppression of deterioration in ion balance at the time of adjustment of the voltage value and the application time of the drive voltage. Accordingly, it is possible to hold the ion balance uniform regardless of the distance from the static eliminator.

In addition to the above configuration, a static eliminator according to another embodiment of the present invention includes an ion balance detecting device that detects ion balance between positive ions and negative ions in a periphery of the discharge electrode, wherein the drive controlling device controls an adjustment amount of the voltage value and an adjustment amount of the application time based on the detected ion balance. With such a configuration, it is possible to automatically adjust the voltage value and the application time of the drive voltage in accordance with the detected value of the ion balance.

In addition to the above configuration, a static eliminator according to another embodiment of the present invention includes a target value storing device that holds respective target values of the ion balance and the average potential, and an electrode voltage detecting device that detects an output voltage of the discharge electrode, wherein the drive controlling device repeatedly performs voltage adjustment processing to adjust the respective voltage values of the positive drive voltage and the negative drive voltage until the ion balance agrees with the corresponding target value, and after completion of the voltage adjustment processing, the respective application time of the positive drive voltage and the negative drive voltage are adjusted such that the average potential obtained from the output voltage agrees with the corresponding target value.

With such a configuration, the respective application time of the positive drive voltage and the negative drive voltage are adjusted after completion of the voltage adjustment processing based on the ion balance, and it is thereby possible to promptly make the ion balance and the average potential closer to desired target values.

In addition to the above configuration, in a static eliminator according to another embodiment of the present invention, the ion balance detecting device detects the ion balance based on a current flowing between a ground electrode and a ground/earth, and the electrode voltage detecting device detects the output power based on a current flowing between a secondary ground terminal of a step-up transformer and the ground/earth.

With such a configuration, the ion balance is detected by means of the current flowing between the ground electrode and the ground/earth, and it is thereby possible to simplify the configuration of the eliminator as compared with the case of using a surface electrometer or an ion monitor. Further, the output voltage is detected by means of the current flowing between the secondary ground terminal of the step-up transformer and the ground/earth, and it is thereby possible to reduce manufacturing cost of the eliminator as compared with the case of directly detecting the output voltage of the discharge electrode by means of a voltage dividing resistor.

A static elimination control method according to another embodiment of the present invention includes an electrode driving step for alternately and repeatedly applying, to a discharge electrode, a positive drive voltage and a negative drive voltage as drive voltages for corona discharge, a voltage value adjusting step for adjusting at least one of a voltage value of the positive drive voltage and a voltage value of the negative drive voltage, an application time adjusting step for adjusting at least one of an application time of the positive drive voltage and an application time of the negative drive voltage; and a drive controlling step for controlling an adjustment amount of the voltage value and an adjustment amount of the application time, wherein in the drive controlling step, a ratio of the application time of the positive drive voltage is decreased while the voltage value of the positive drive voltage is relatively decreased in a case of increasing positive ions, and a ratio of the application time of the positive drive voltage is increased while the voltage value of the positive drive voltage is relatively decreased in a case of increasing negative ions.

In the static eliminator and the static elimination control method according to the present invention, it is possible to hold constant an average potential of a discharge electrode for a time longer than a repeated interval of a drive voltage, so as to suppress deterioration in ion balance at the time of adjustment of a voltage value and an application time of the drive voltage.

Hence, it is possible to respectively generate positive ions and negative ions in desired amounts, and also hold the ion balance uniform regardless of a distance from the static eliminator. It is particularly possible to suppress deterioration in ion balance in the vicinity of the static eliminator, so as to improve distance characteristics for the ion balance.

DETAILED DESCRIPTION OF PREFERRED EMBODIMENTS

First Embodiment

<Static Eliminator 1>

Figure 1:
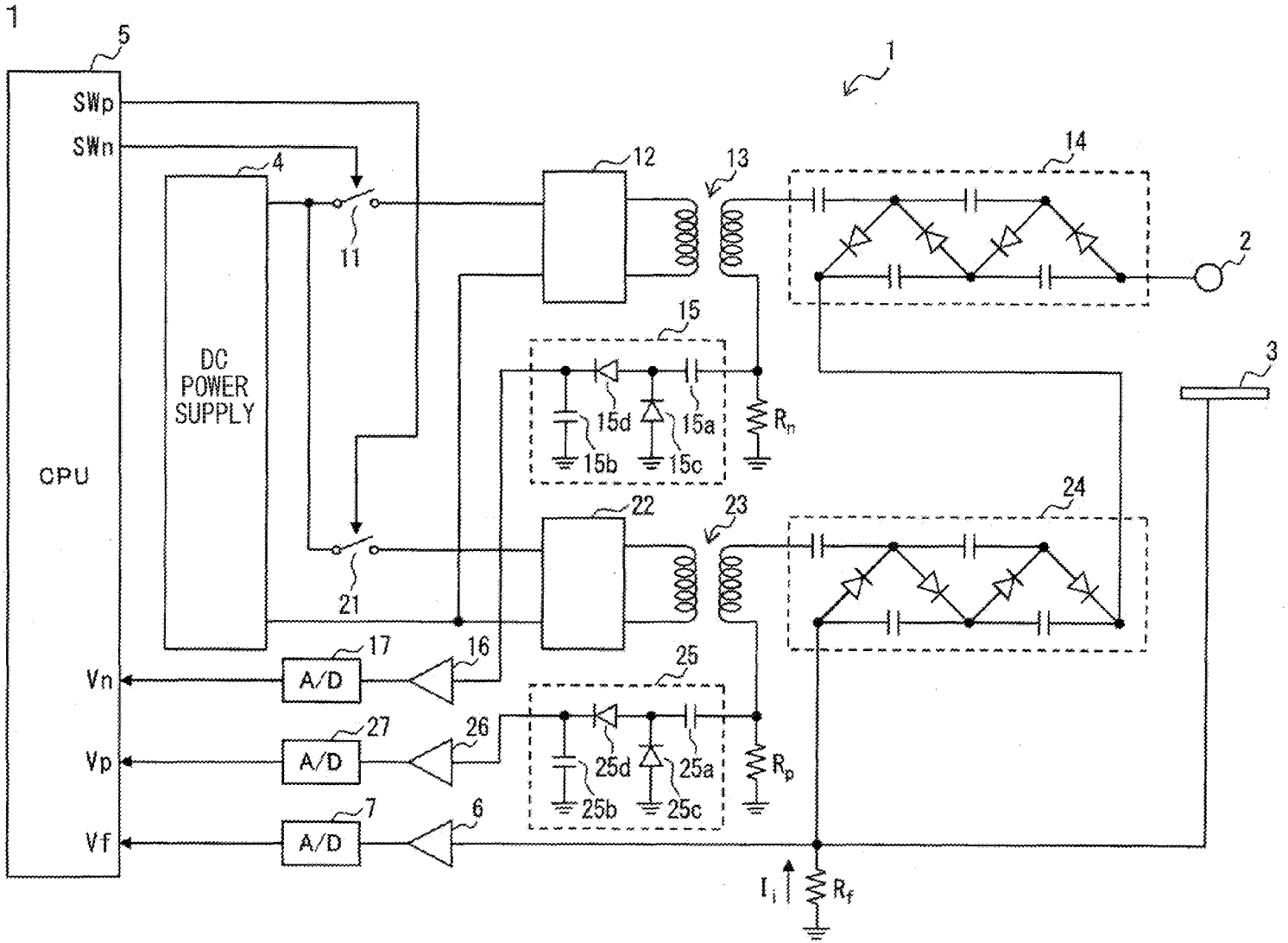
FIG. 1 is a block diagram showing a configuration example of a static eliminator 1 according to a first embodiment of the present invention, showing a pulse AC-system static eliminator.

FIG. 1 is a block diagram showing a configuration example of a static eliminator 1 according to a first embodiment of the present invention, showing a pulse AC-system static eliminator. The static eliminator 1 includes a discharge electrode 2, a ground electrode 3, a DC power supply 4, a CPU 5, amplifiers 6, 16, 26, A/D converters 7, 17, 27, switching elements 11, 21, oscillator circuits 12, 22, step-up transformers 13, 23, voltage-doubler rectifier circuits 14, 24, and voltage detecting rectifier circuits 15, 25.

The oscillator circuit 12, the step-up transformer 13, and the voltage-doubler rectifier circuit 14 are an electrode driving unit for repeatedly applying a negative-side drive voltage $V_2$ to the discharge electrode 2. The oscillator circuit 22, the step-up transformer 23, and the voltage-doubler rectifier circuit 24 are an electrode driving unit for repeatedly applying a positive-side drive voltage $V_1$ to the discharge electrode 2.

The discharge electrode 2 is an electrode for making corona discharge occur by application of a predetermined drive voltage and is, for example, made up of one or more than one conductor needles. The positive-side drive voltage $V_1$ and the negative-side drive voltage $V_2$ are alternately and repeatedly applied to the discharge electrode 2. The ground electrode 3 is a ground electrode for collecting a discharge current, and is connected to a ground/earth via an ion-current detecting resistance element Rf.

The DC power supply 4 is a power supply unit for supplying a DC power supply from the oscillator circuit 12 to the oscillator circuit 22, and a predetermined DC voltage $V_{DC}$ is applied to the oscillator circuit 22 via the switching element 21, while being applied to the oscillator circuit 12 via the switching element 11.

The oscillator circuit 12 is an inverter circuit that converts the DC voltage $V_{DC}$ supplied from the DC power supply 4 to an AC voltage $V_{AC}$, to drive the step-up transformer 13. A magnitude of the AC voltage $V_{AC}$ is controlled by adjustment of on-time of the switching element 11 by means of a PWM (Pulse Width Modulation) signal SWn.

The voltage-doubler rectifier circuit 14 is a step-up rectifier circuit made up of a plurality of capacitors and a plurality of diodes (rectifier cells), and the serially connected capacitors are connected in a ladder form by the diodes. The voltage-doubler rectifier circuit 14 is connected to a secondary output terminal of the step-up transformer 13. The secondary ground terminal of the step-up transformer 13 is connected to the ground/earth via an output-voltage detecting resistance element Rn.

The oscillator circuit 22 is an inverter circuit that converts the DC voltage $V_{DC}$, supplied from the DC power supply 4, to the AC voltage $V_{AC}$, to drive the step-up transformer 23. A magnitude of the AC voltage $V_{AC}$ is controlled by adjustment of on-time of the switching element 21 by means of a PWM signal SWp.

The voltage-doubler rectifier circuit 24 is configured similarly to the voltage-doubler rectifier circuit 14, and connected to a secondary output terminal of the step-up transformer 23. There is a difference in orientation of the diodes between the voltage-doubler rectifier circuit 14 and the voltage-doubler rectifier circuit 24. The secondary ground terminal of the step-up transformer 23 is connected to the ground/earth via an output-voltage detecting resistance element Rp.

A current outputted from the static eliminator 1 is referred to as an ion current Ii, and shows ion balance between positive ions and negative ions generated by electrolysis of the air or the like on the periphery of the discharge electrode 2 due to corona discharge. The ion current Ii flows from the ground/earth to the ground electrode 3 side via the resistance element Rf.

The resistance element Rf is a resistor for converting, to a voltage signal, the ion current Ii flowing from the ground/earth to the ground electrode 3 side, and a voltage signal after the conversion is amplified by the amplifier 6, and converted to digital data by the A/D converter 7. That is, ion balance is detected by the resistance element Rf, the amplifier 6, and the A/D converter 7. Herein, a detected value for ion balance is taken as Vf.

The voltage detecting rectifier circuit 15 is a rectifier circuit for detecting a negative-side output voltage by means of the current flowing through the secondary ground terminal of the step-up transformer 13, and is made up of two capacitors 15*a*, 15*b* and two diodes 15*c*, 15*d*. In the voltage detecting rectifier circuit 15, the capacitor 15*a* and the diode 15*c* are connected in series between an input terminal and the ground/earth, the diode 15*d* and the capacitor 15*b* are connected in series between a cathode terminal of the diode 15*c* and the ground/earth, and the cathode terminal of the diode 15*d* is connected to an output terminal.

The resistance element Rn is a resistor for converting, to a voltage signal, a current flowing from the secondary ground terminal of the step-up transformer 13 to the ground/earth, and a voltage signal after the conversion is full-wave rectified by the rectifier circuit 15. The voltage signal after the full-wave rectification by the rectifier circuit 15 is amplified by the amplifier 16, and converted to digital data by the A/D converter 17. Herein, a detected value of the negative-side output voltage is taken as Vn.

The voltage detecting rectifier circuit 25 is a rectifier circuit for detecting a positive-side output voltage by means of the current flowing through the secondary ground terminal of the step-up transformer 23, and is made up of two capacitors 25*a*, 25*b* and two diodes 25*c*, 25*d*, similarly to the voltage detecting rectifier circuit 15. The resistance element Rp is a resistor for converting, to a voltage signal, a current flowing from the secondary ground terminal of the step-up transformer 23 to the ground/earth, and a voltage signal after the conversion is full-wave rectified by the rectifier circuit 25. The voltage signal after the full-wave rectification by the rectifier circuit 25 is amplified by the amplifier 26, and converted to digital data by the A/D converter 27. Herein, a detected value of the positive-side output voltage is taken as Vp.

The CPU 5 is an ion balance controlling processor that adjusts respective voltage values and application times of the positive-side drive voltage $V_1$ and the negative-side drive voltage $V_2$ based on respective detection results of the ion balance, the positive-side output voltage, and the negative-side output voltage. The detected values Vf, Vp, and Vn of the ion balance, the positive-side output voltage, and the negative-side output voltage are respectively inputted into predetermined input ports of the CPU 5. Further, the PWM signals SWn, SWp for turning on or off the switching elements 11, 21 are outputted respectively from predetermined output ports.

A voltage value of the positive-side drive voltage $V_1$ is controlled by adjustment of a pulse width of the PWM signal SWp, and a voltage value of the negative-side drive voltage $V_2$ is controlled by adjustment of a pulse width of the PWM signal SWn. An application time Tp of the positive-side drive voltage $V_1$ is a duration for holding the positive-side drive voltage $V_1$, and is controlled by adjustment of an on-period Tip of the switching element 21. An application time Tn of the negative-side drive voltage $V_2$ is a duration for holding the negative-side drive voltage $V_2$, and controlled by adjustment of an on-period Tin of the switching element 11. Alternate and repeated turning-on of the switching elements 11, 21 can lead to respective generation of the positive ions and the negative ions.

In the static eliminator 1, in order to improve distance characteristics for ion balance, a ratio between the application time Tp of the positive-side drive voltage $V_1$ and the application time Tn of the negative-side drive voltage $V_2$ is adjusted such that an average potential $V_0$ of the discharge electrode 2 is held constant.

<PMW Signal>

Figure 2:
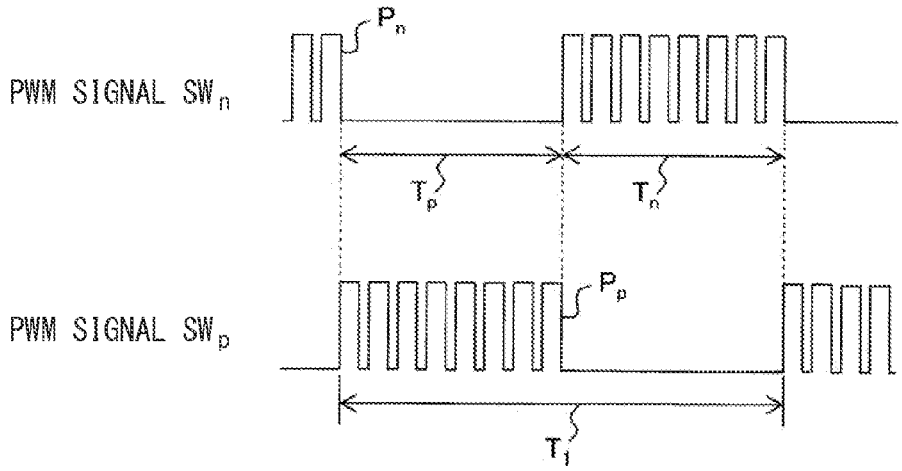
FIG. 2 is a timing chart showing an example of drive operations of a discharge electrode 2 in the static eliminator 1 of FIG. 1, showing PWM signals SWn, SWp generated by a CPU 5.

FIG. 2 is a timing chart showing an example of drive operations of the discharge electrode 2 in the static eliminator 1 of FIG. 1, showing the PWM signals SWn, SWp generated by the CPU 5. The application time Tn of the negative-side drive voltage $V_2$ and the application time Tp of the positive-side drive voltage $V_1$ are respectively controlled by the on-periods of the switching elements 11, 21.

The PWM signal SWn is a pulse signal in which a PWM pulse Pn is repeatedly output in a certain cycle $T_{11}$ during the on-period Tin of the switching element 11. Meanwhile, the PWM signal SWp is a pulse signal in which a PWM pulse Pp is repeatedly output in the certain cycle $T_{11}$ during the on-period Tip of the switching element 21.

The switching element 11 is intermittently turned on by the PWM pulse Pn during the on-period Tin, and continuously turned off during the on-period Tip. The application time Tn of the negative-side drive voltage $V_2$ is regulated by the on-period Tin of the switching element 11. The switching element 21 is intermittently turned on by the PWM pulse Pp during the on-period Tip, and continuously turned off during the on-period Tin. The application time Tp of the positive-side drive voltage $V_1$ is regulated by the on-period Tip of the switching element 21.

The cycle $T_1$ is a repeated interval at the time of alternate and repeated application of the negative-side drive voltage $V_2$ and the positive-side drive voltage $V_1$, and referred to as a static elimination cycle. This static elimination cycle $T_1$ corresponds to the repeated interval at the time of alternately and repeatedly turning-on the switching elements 11, 21, and expressed by $T_1$=Tp+Tn.

<Duty Ratio of PWM Pulse>

Figure 3:
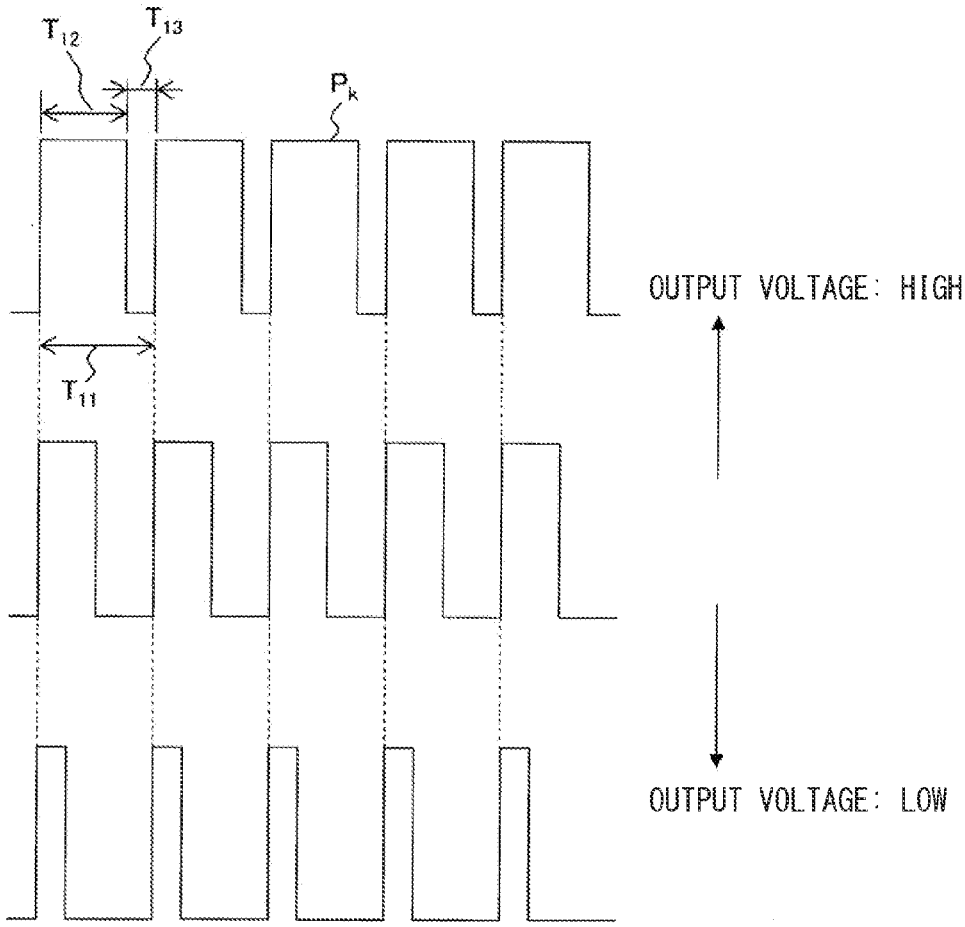
FIG. 3 is a diagram showing an example of drive operations of the discharge electrode 2 in the static eliminator 1 of FIG. 1, showing a PWM pulse Pk with a different pulse width in accordance with an output voltage.

FIG. 3 is a diagram showing an example of the drive operations of the discharge electrode 2 in the static eliminator 1 of FIG. 1, showing a PWM pulse Pk with a different pulse width in accordance with an output voltage. This figure shows the case of changing duty ratio Dp of PWM pulse Pk=$T_{12}/T_{11}$, while holding the cycle $T_{11}$ ($T_{11}<T_1$) constant at the time of repeated output of the PWM pulse Pk.

The voltage value of the negative-side drive voltage $V_2$ and the voltage value of the positive-side drive voltage $V_1$ are respectively controlled by pulse widths of the PWM pulses Pn, Pp. A pulse width $T_{12}$ of the PWM pulse Pk (k=n, p) is a time from rising to falling of the PWM pulse SWk, and corresponds to the on-time of the switching elements 11, 21 with respect to each PWM pulse Pk. When the off-time of the switching elements 11, 21 with respect to each PWM pulse Pk is referred to as $T_{13}$, $T_{11}=T_{12}+T_{13}$ is held.

The duty ratio Dp is a ratio between the pulse width $T_{12}$ and the cycle $T_{11}$. The output voltage of the discharge electrode 2 is increased by lengthening the pulse width $T_{12}$ so as to increase the duty ratio Dp. On the other hand, the output voltage is decreased by shortening the pulse width $T_{12}$ so as to decrease the duty ratio Dp. For example, when the duty ratio Dp of the PWM pulse Pn is increased, the voltage value of the negative-side drive voltage $V_2$ becomes higher, to allow an increase in negative ions.

For example, the static elimination cycle $T_1$ is $T_1$=the order of 0.005 to 10 seconds, whereas the cycle $T_{11}$ is designated to be a value being smaller than one-hundredth of the static elimination cycle $T_1$.

<Duty Ratio of Application Time>

Figure 4:
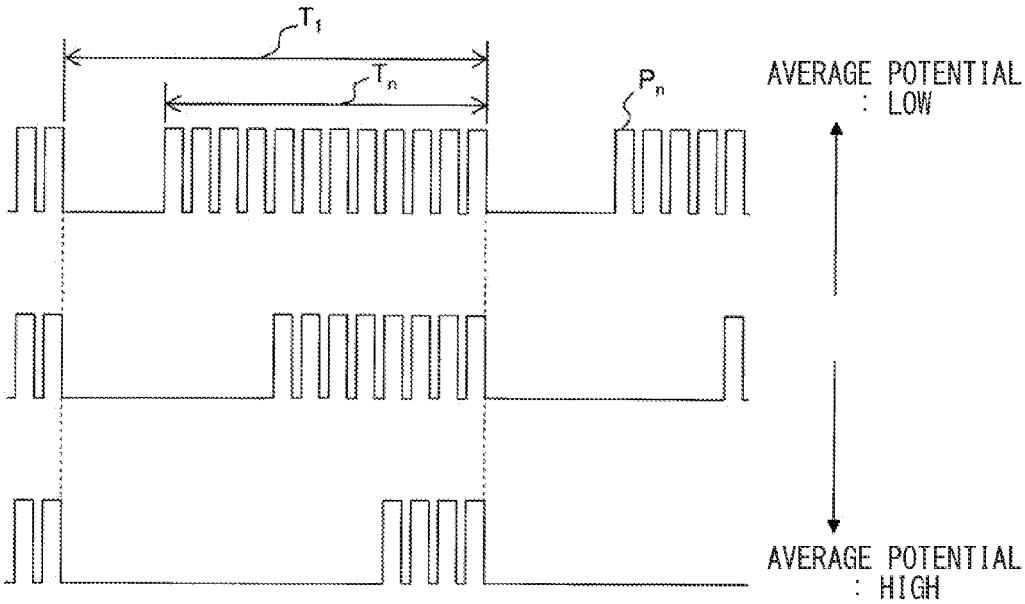
FIG. 4 is a diagram showing an example of the drive operations of the discharge electrode 2 in the static eliminator 1 of FIG. 1, showing a PWM signal SWn with a different duty ratio in accordance with an average potential $V_0$ of the discharge electrode 2.

FIG. 4 is a diagram showing an example of the drive operations of the discharge electrode 2 in the static eliminator 1 of FIG. 1, showing the PWM signal SWn with a different duty ratio in accordance with the average potential $V_0$ of the discharge electrode 2. FIG. 4 shows the case of changing duty ratio Ds of application time=$Tn/T_1$, while holding constant the repeated interval at the time of alternately and repeatedly turning-on the switching elements 11, 21, namely, the static elimination cycle $T_1$.

The application time Tn of the negative-side drive voltage $V_2$ is controlled by the on-period Tin of the switching element 11. The duty ratio Ds is a ratio between the application time Tn of the negative-side drive voltage $V_2$ and the static elimination cycle $T_1$.

The average potential $V_0$ is a time average value obtained by averaging the potential of the discharge electrode 2 by a time longer than the static elimination cycle $T_1$. In a case where the respective voltage values of the positive-side drive voltage $V_1$ and the negative-side drive voltage $V_2$ are constant, the average potential $V_0$ decreases when the application time Tn is lengthened to increase the duty ratio Ds. On the other hand, the average potential $V_0$ increases when the application time Tn is shortened to decrease the duty ratio Ds.

Accordingly, in order to adjust the ratio between the application time Tp of the positive-side drive voltage $V_1$ and the application time Tn of the negative-side drive voltage $V_2$, namely, the duty ratio Ds, while holding the average potential $V_0$ constant, for example, the voltage value of the negative-side drive voltage $V_2$ is decreased or the voltage value of the positive-side drive voltage $V_1$ is increased in the case of increasing the duty ratio Ds. On the other hand, in the case of decreasing the duty ratio Ds, the voltage value of the negative-side drive voltage $V_2$ is increased or the voltage value of the positive-side drive voltage $V_1$ is decreased. That is, the voltage value of the drive voltage and the application time of the drive voltage are changed in mutually opposite directions.

Figure 5:
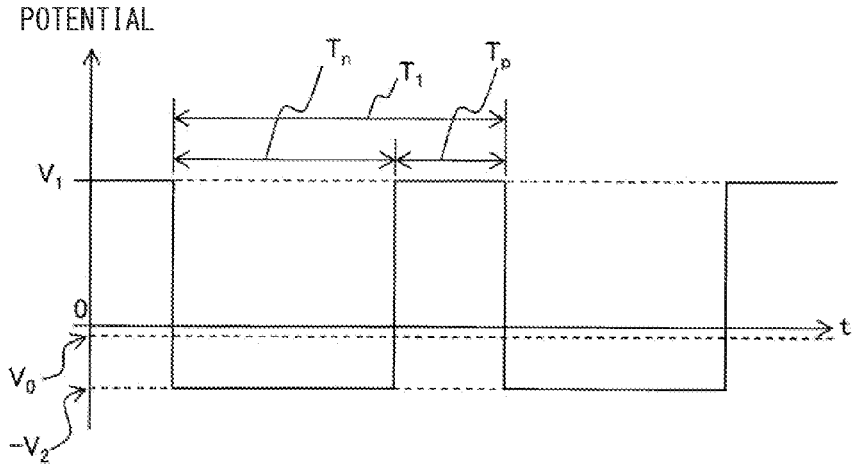
FIG. 5 is a diagram showing an example of the drive operations of the discharge electrode 2 in the static eliminator 1 of FIG. 1, showing a potential of the discharge electrode 2.

FIG. 5 is a diagram showing an example of the drive operations of the discharge electrode 2 in the static eliminator 1 of FIG. 1, showing a potential of the discharge electrode 2. The positive-side drive voltage $V_1$ and the negative-side drive voltage $V_2$ are alternately and repeatedly applied to the discharge electrode 2.

In this example, duty ratio Ds of application time=$Tn/T_1$ is larger than 1/2, and the positive-side drive voltage $V_1$ is larger than the negative-side drive voltage $V_2$. In the case of increasing the duty ratio Ds, the average potential $V_0$ ($V_0<0$ in this case) can be held constant by increasing the voltage value of the positive-side drive voltage $V_1$ or decreasing the voltage value of the negative-side drive voltage $V_2$.

On the other hand, in the case of decreasing the duty ratio Ds, the voltage value of the positive-side drive voltage $V_1$ may be decreased or the voltage value of the negative-side drive voltage $V_2$ may be increased.

<CPU 5>

Figure 6:
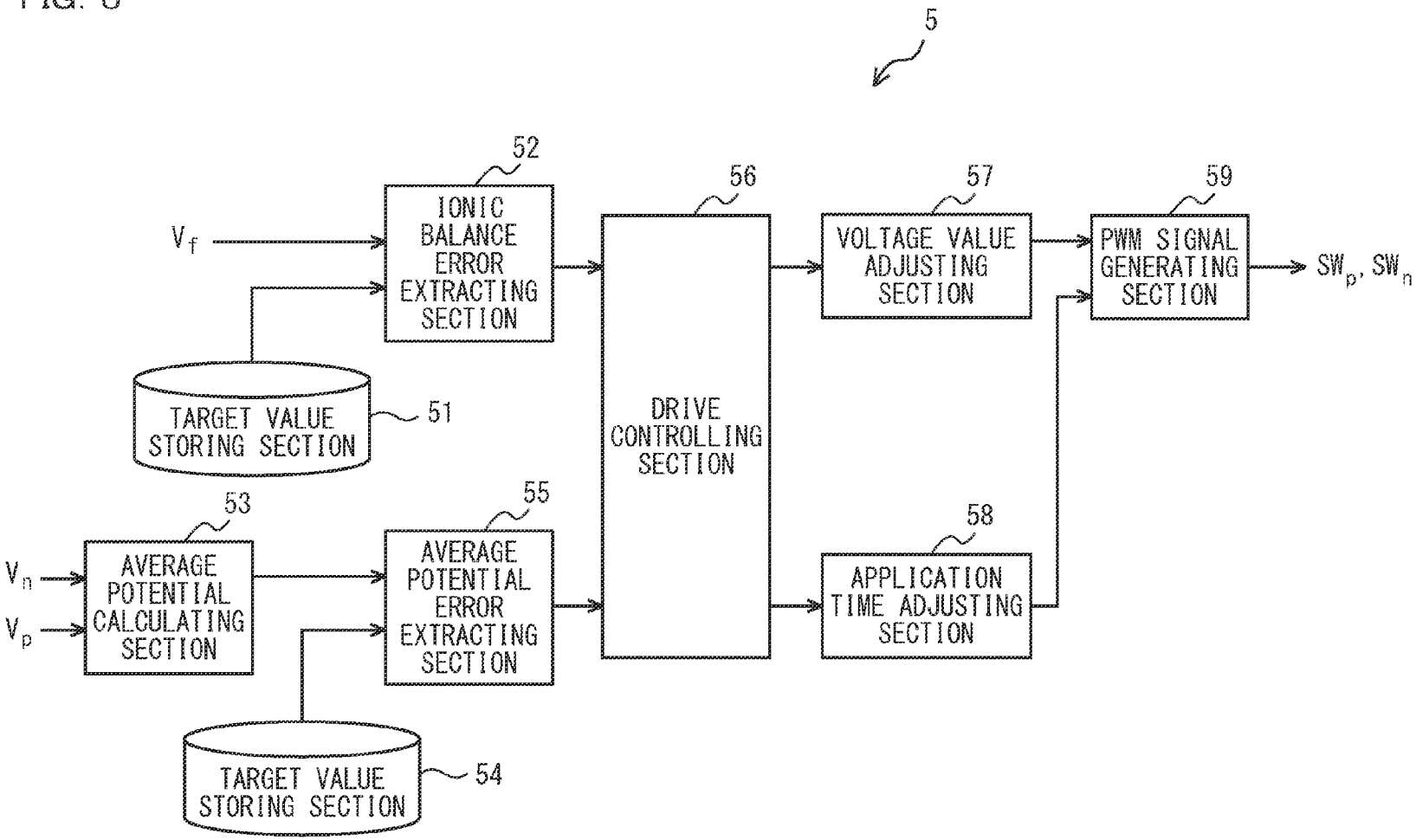
FIG. 6 is a block diagram showing a configuration example inside the CPU 5 of FIG. 1.

FIG. 6 is a block diagram showing a configuration example inside the CPU 5 of FIG. 1. The CPU 5 includes a target value storing sections 51, 54, an ion balance error extracting section 52, an average potential calculating section 53, an average potential error extracting section 55, a drive controlling section 56, a voltage value adjusting section 57, an application time adjusting section 58, and a PWM signal generating section 59. Respective target values of the ion balance and the average potential $V_0$ are held in the target value storing sections 51, 54. These target values can be arbitrarily designated based, for example, on a user's operation.

The ion balance error extracting section 52 compares a detected value Vf of the ion balance with a corresponding target value, to obtain an ion balance control error and output the obtained value to the drive controlling section 56. The voltage value adjusting section 57 adjusts the voltage value of the positive-side drive voltage $V_1$ and the voltage value of the negative-side drive voltage $V_2$ based on the ion balance control error. The average potential calculating section 53 obtains the average potential $V_0$ from detected values Vn, Vp of the output voltage, and outputs the obtained value to the average potential error extracting section 55. The average potential $V_0$ is obtained by $V_0=Vp-Vn$.

The average potential error extracting section 55 compares the average potential $V_0$, obtained by the average potential calculating section 53, with a corresponding target value, to obtain a control error of the average potential and output the obtained value to the drive controlling section 56. The application time adjusting section 58 adjusts the application time Tp of the positive-side drive voltage $V_1$ and the application time Tn of the negative-side drive voltage $V_2$ based on the average potential control error.

The drive controlling section 56 controls adjustment amounts of the voltage values and adjustment amounts of the application times Tp, Tn of the drive voltages $V_1$, $V_2$ based on the control errors of the ion balance and the average potential. The PWM signal generating section 59 generates the PWM signals SWp, SWn based on outputs of the voltage value adjusting section 57 and the application time adjusting section 58.

Specifically, duty ratio Ds of application time=$Tn/T_1$ and duty ratio Dp of PWM pulses Pp, $Pn=T_{12}/T_{11}$ are decided such that the ion balance and the average potential $V_0$ respectively agree with the target values. At that time, the drive controlling section 56 adjusts the duty ratios Ds, Dp so as to hold the average potential $V_0$ constant. For example, in the case of increasing the positive ions, the duty ratio Dp of the PWM pulse Pn is decreased while the duty ratio Dp of the PWM pulse Pp is increased, and the application time Tp of the positive-side drive voltage $V_1$ is shortened, namely, the duty ratio Ds is increased.

As opposed to this, in the case of increasing the negative ions, the duty ratio Dp of the PWM pulse Pp is decreased while the duty ratio Dp of the PWM pulse Pn is increased and the application time Tn of the negative-side drive voltage $V_2$ is shortened, namely, the duty ratio Ds is decreased. That is, while the voltage value of the drive voltage with the same polarity as ions to be increased is increased, the voltage value of the drive voltage with the reverse polarity is decreased, and the ratio of the application time of the drive voltage with the same polarity is decreased.

Herein, the relation between the duty ratio Ds and the voltage value of the positive-side drive voltage $V_1$ as well as the voltage value of the negative-side drive voltage $V_2$ is, for example, previously held as a predetermined voltage table. Alternatively, these drive parameters may be calculated by means of a function made up of a predetermined arithmetic expression.

As described above, since the duty ratio Ds of the application time and the respective duty ratios Dp of the PWM pulses Pp, Pn are adjusted while the average potential $V_0$ is held constant, it is possible to suppress deterioration in ion balance at the time of adjustment of these drive parameters in accordance with the detected values of the ion balance and the output voltage.

Generally, voltage characteristics of the currents (discharge currents) flowing through the discharge electrode 2 due to corona discharge in the positive polarity and the negative electrode are not symmetrical. For example, a lower limit of the negative-side drive voltage $V_2$ required for corona discharge is smaller than a lower limit of the positive-side drive voltage $V_1$ required for the same. Further, the relation between the drive voltage and the discharge current is nonlinear, and the discharge current increases exponentially with increase in drive voltage, but a ratio of the change significantly differs between the positive side and the negative side.

Thereat, in the static eliminator 1 according to the present embodiment, the voltage value of the drive voltage to exert a large effect on discharge characteristics, namely, each of the duty ratios Dp of the PWM pulses Pp, Pn, is adjusted and then the duty ratio Ds of the application time is adjusted. Specifically, the voltage adjustment processing for adjusting the respective duty ratios Dp of the PWM pulses Pp, Pn is repeatedly performed such that the ion balance agrees with the target value. Then, processing for adjusting the duty ratio Ds is performed such that the average potential $V_0$ agrees with the target value.

<Ion Balance Control>

Figure 7:
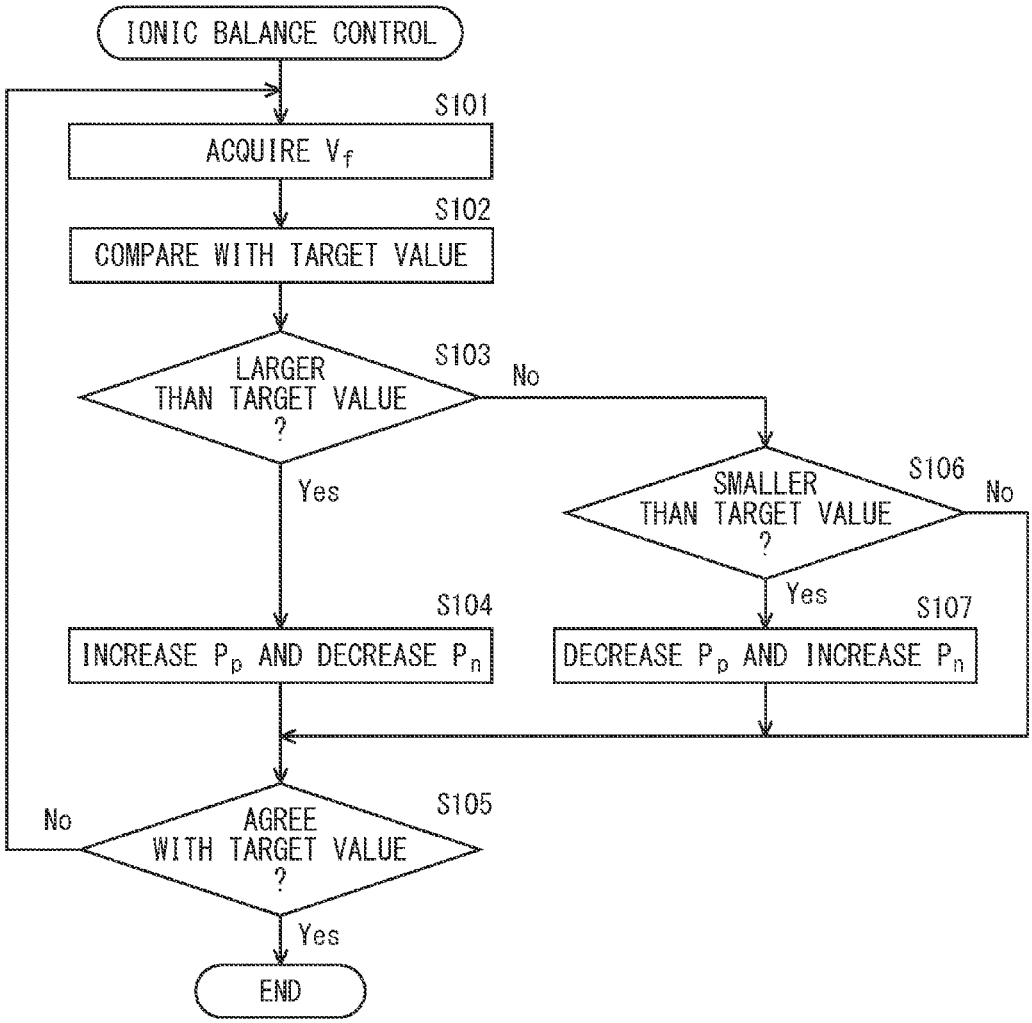
FIG. 7 is a flowchart showing an example of operations at the time of ion balance control in the CPU 5 of FIG. 6.

In FIG. 7, steps S101 to S107 show a flowchart of an example of operations at the time of ion balance control in the CPU 5 of FIG. 6, and processing is shown which adjusts the respective duty ratios Dp of the PWM pulses Pp, Pn based on the detected value of the ion balance. First, the CPU 5 acquires the detected value Vf of the ion balance, and compares the acquired value with the target value (step S101, S102).

At this time, when Vf is larger than the target value, the CPU 5 determines that there are excessive negative ions, and in order to increase the positive ions, the CPU 5 decreases the duty ratio Dp of the PWM pulse Pn, while increasing the duty ratio Dp of the PWM pulse Pp (steps S103, S104)

On the other hand, when Vf is smaller than the target value, the CPU 5 determines that there are excessive positive ions, and in order to increase the negative ions, the CPU 5 increases the duty ratio Dp of the PWM pulse Pn, while decreasing the duty ratio Dp of the PWM pulse Pp (steps S103, S106, S107). The CPU 5 repeats the processing orders of steps S101 to S104, S106 and S107 until Vf agrees with the target value (step S105).

<Voltage Control>

Figure 8:
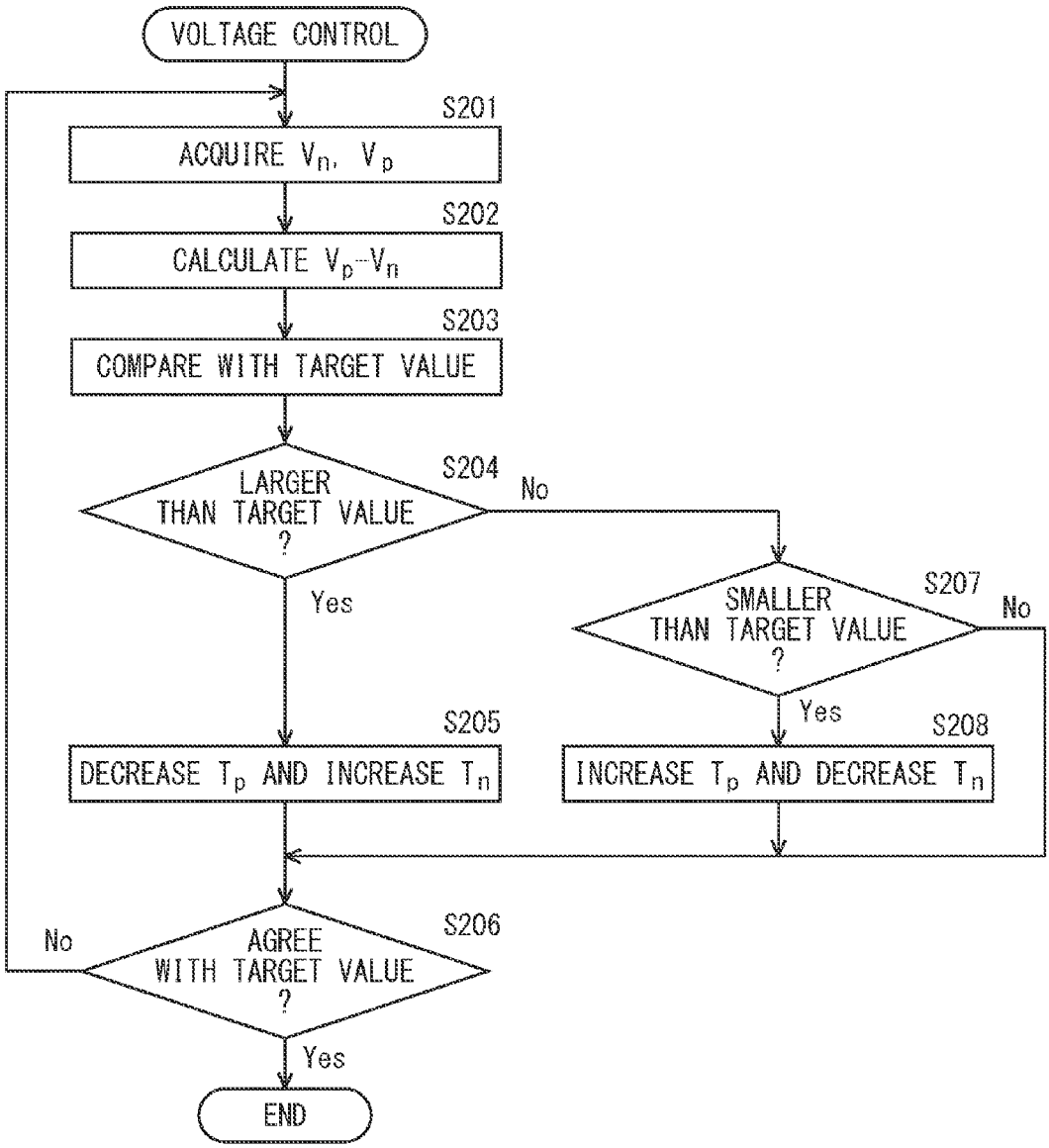
FIG. 8 is a flowchart showing an example of operations at the time of voltage control in the CPU 5 of FIG. 6.

In FIG. 8, steps S201 to S208 show a flowchart of an example of operations at the time of voltage control in the CPU 5 of FIG. 6, and processing is shown which adjusts the duty ratios D based on the detected value of the output voltage. First, the CPU 5 acquires the detected values Vn, Vp of the output voltage, and calculates an average potential $V_0$ from the difference (Vp−Vn) therebetween (step S201, S202).

Subsequently, the CPU 5 compares the obtained average potential $V_0$ with the target value, and when the average potential $V_0$ is larger than the target value, in order to decrease the average potential $V_0$, the CPU 5 increases the application time Tn while decreasing the application time Tp, to increase the duty ratio Ds of the application time (steps S203 to S205).

On the other hand, when the average potential $V_0$ is smaller than the target value, in order to increase the average potential $V_0$, the CPU 5 decreases the application time Tn while increasing the application time Tp, to decrease the duty ratio Ds of the application time (steps S204, S207, S208). The CPU 5 repeats the processing orders of steps S201 to S205, S207 and S208 until the average potential $V_0$ agrees with the target value (step S206).

<Distance Characteristics for Ion Balance>

Figure 9:
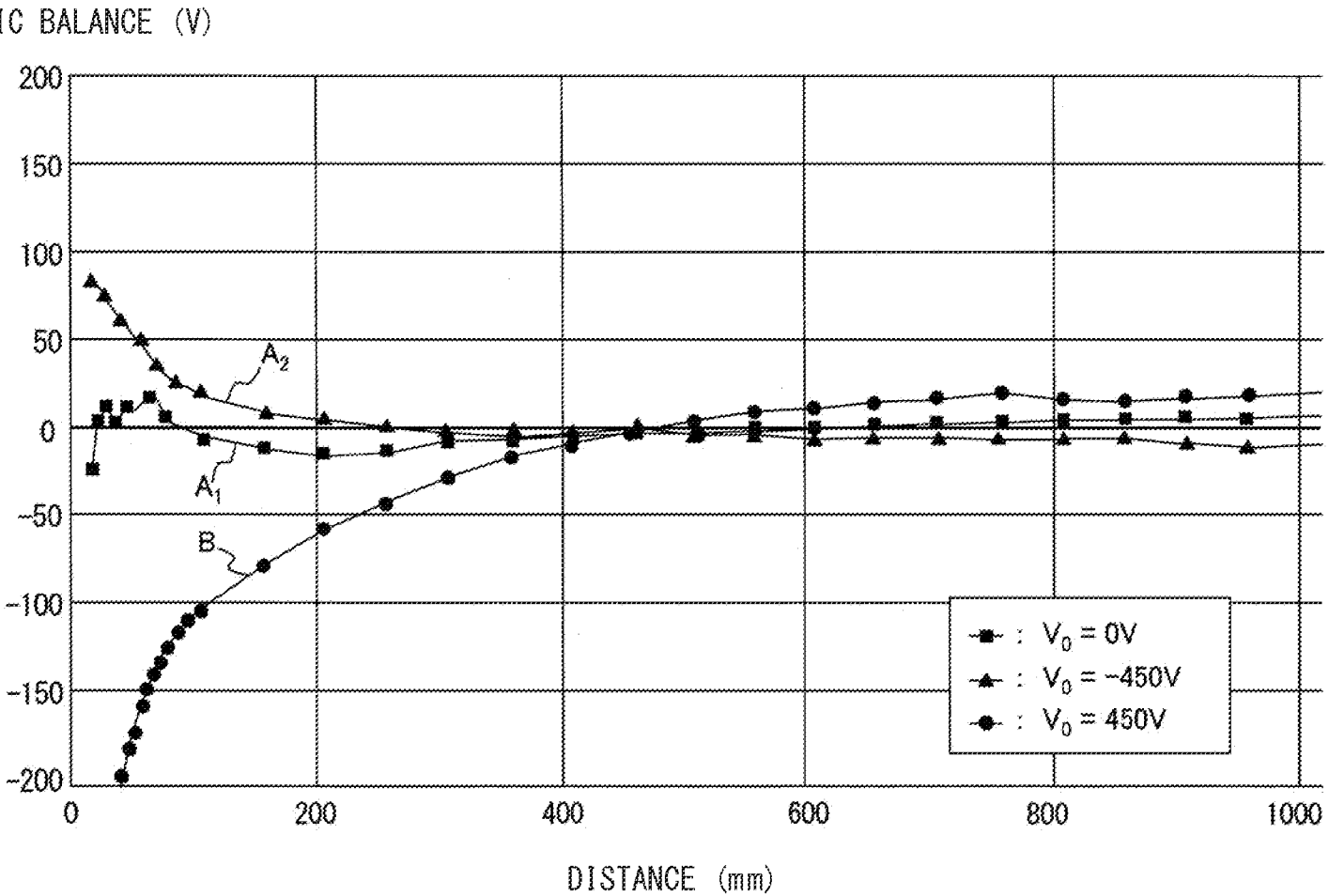
FIG. 9 is a diagram showing distance characteristics for ion balance measured using the static eliminator 1 of FIG. 1.

FIG. 9 is a diagram showing distance characteristics for ion balance measured using the static eliminator 1 of FIG. 1, in comparison with the conventional example. In FIG. 9, detection point groups obtained by using the static eliminator 1 are shown as measurement results $A_1$, $A_2$, and a detection point group obtained by using the conventional static eliminator is shown as a measurement result B.

Further, the measurement result $A_1$ in FIG. 9 is the case of the target value of the average potential $V_0$ being $V_0$=0 (V), and the measurement result $A_2$ is the case of the target value of the average potential $V_0$ being $V_0$=−450 (V). Moreover, the measurement result B is the case of the target value of the average potential $V_0$ being $V_0$=450 (V). In FIG. 9, a horizontal axis indicates a distance from the static eliminator 1, and a vertical axis indicates the ion balance. Further, the drive voltages $V_1$, $V_2$ are on the order of 5 to 7 kV.

In the conventional static eliminator, drive control for the discharge electrode is performed such that the average potential becomes positive in order to bring about even discharge at the time of positive-side drive and the negative-side drive. For this reason, the ion balance becomes zero at a specific distance from the static eliminator, in the vicinity of 460 mm in this example, but the ion balance in the vicinity of the static eliminator significantly deteriorates.

For example, the ion balance abruptly increases from −200 to −110 (V) in the range of the distance from the static eliminator being 50 to 100 mm. Further, the ion balance gently increases from −110 to −10 (V) in the range of the distance being 100 to 400 mm.

As opposed to this, in the static eliminator 1, ion balance is generally held constant regardless of the distance from the static eliminator 1. Especially in the case of average potential $V_0$=0 (V), the ion balance in the vicinity of the static eliminator 1 is significantly improved. For example, the ion balance is from −30 to 0 (V) in the range of the distance from the static eliminator 1 being 20 to 100 mm. Moreover, the ion balance is in the range of −15 to 10 (V) in the range of the distance being not shorter than 100 mm.

In the case of average potential $V_0$=−450 (V), the ion balance in the vicinity of the static eliminator 1 slightly deteriorates, but is within the range of −10 to 5 (v) in the range of the distance from the static eliminator 1 being not shorter than 200 mm, and hence the ion balance in a position far from the static eliminator 1 has been improved. That is, in the static eliminator 1, it is possible to individually control generated amounts of the positive ions and the negative ions and the distance characteristics for ion balance. Therefore, for example, designating the negative value as the target value of the average potential $V_0$ can improve the ion balance at the position far from the static eliminator 1, while increasing the generated amount of the ions with the reverse polarity to the conventional static eliminator in the vicinity of the static eliminator 1.

According to the present embodiment, since the ratios between the respective voltage values and application times of the positive-side drive voltage $V_1$ and the negative-side drive voltage $V_2$ are adjusted such that the average potential $V_0$ of the discharge electrode 2 is held constant, it is possible to suppress deterioration in ion balance at the time of adjustment of these drive parameters in accordance with the detected value of the ion balance. Therefore, designating the respective voltage values and application times of the drive voltages $V_1$, $V_2$ as appropriate with respect to the detected value of the ion balance can hold the ion balance uniform regardless of the distance from the static eliminator 1. It is particularly possible to suppress deterioration in ion balance in the vicinity of the static eliminator 1.

Further, since the ion balance is detected by means of the current Ii flowing between the ground electrode 3 and the ground/earth, it is possible to simplify the configuration of the static eliminator 1 as compared with the case of using a surface electrometer or an ion monitor. Moreover, since the output voltage is detected by means of the current flowing between the secondary ground terminals of the step-up transformers 13, 23 and the ground/earth, it is possible to reduce manufacturing cost of the static eliminator 1 as compared with the case of directly detecting the output voltage of the discharge electrode 2 by means of a voltage dividing resistor.

Second Embodiment

In the first embodiment, the example of the case has been described where the present invention is applied to the pulse AC-system static eliminator. As opposed to this, in the present embodiment, a case will be described where the present invention is applied to the AC-system static eliminator and a ratio between an application time of the positive drive voltage and an application time of the negative drive voltage will be adjusted such that the average potential $V_0$ of the discharge electrode is held constant.

Figure 10:
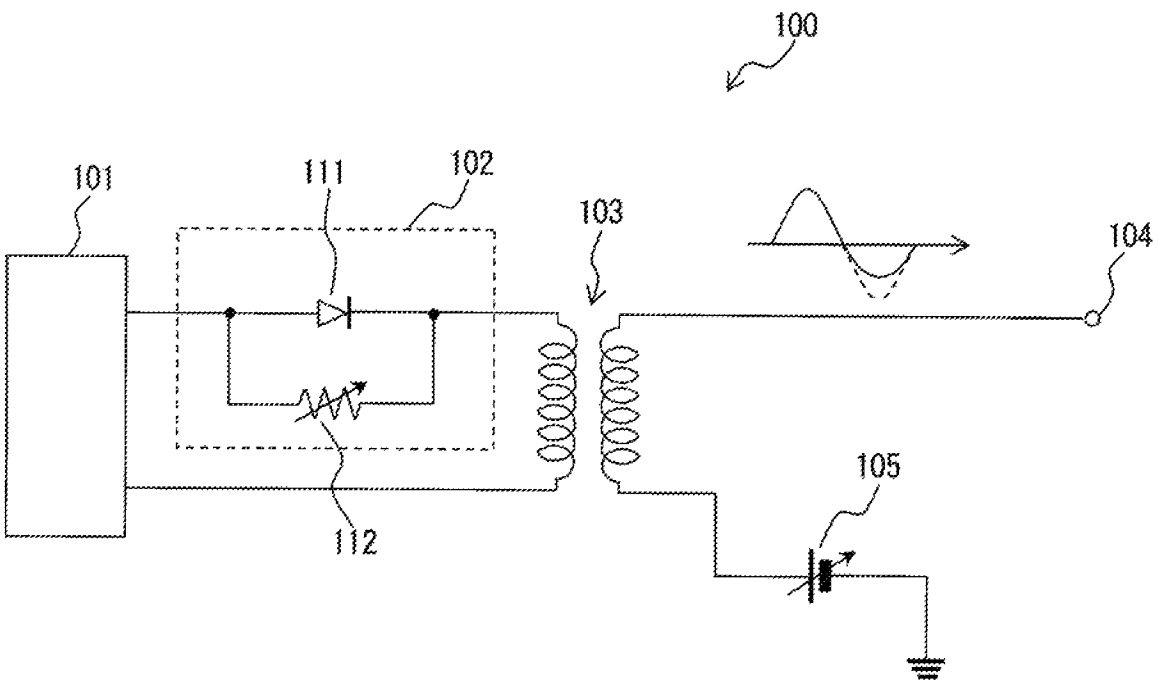
FIG. 10 is a block diagram showing a configuration example of a static eliminator 100 according to a second embodiment of the present invention.

FIG. 10 is a block diagram showing a configuration example of a static eliminator 100 according to a second embodiment of the present invention. The static eliminator 100 is an AC-system static eliminator in which an AC voltage is applied to a single discharge electrode 104, and is made up of an AC power supply 101, a voltage waveform adjuster circuit 102, a step-up transformer 103, and a DC biasing DC power supply 105. Herein, a control section that controls the voltage waveform adjuster circuit 102 and the DC biasing DC power supply 105, and an ion balance detecting section are omitted.

The AC power supply 101 is a commercial power supply that supplies a predetermined AC voltage to the step-up transformer 103. The DC biasing DC power supply 105 is a power-supply unit for applying a DC bias to the discharge electrode 104, and can adjust a voltage value of a DC voltage. This DC power supply is arranged between a secondary ground terminal of the step-up transformer 103 and the ground/earth.

The voltage waveform adjuster circuit 102 is a circuit for distorting a waveform of an output voltage in each half cycle, and is made up of a diode 111 and a variable resistor 112. The diode 111 is connected in parallel with the variable resistor 112. The voltage waveform adjuster circuit 102 is arranged between the AC power supply 101 and the step-up transformer 103.

Figure 11:
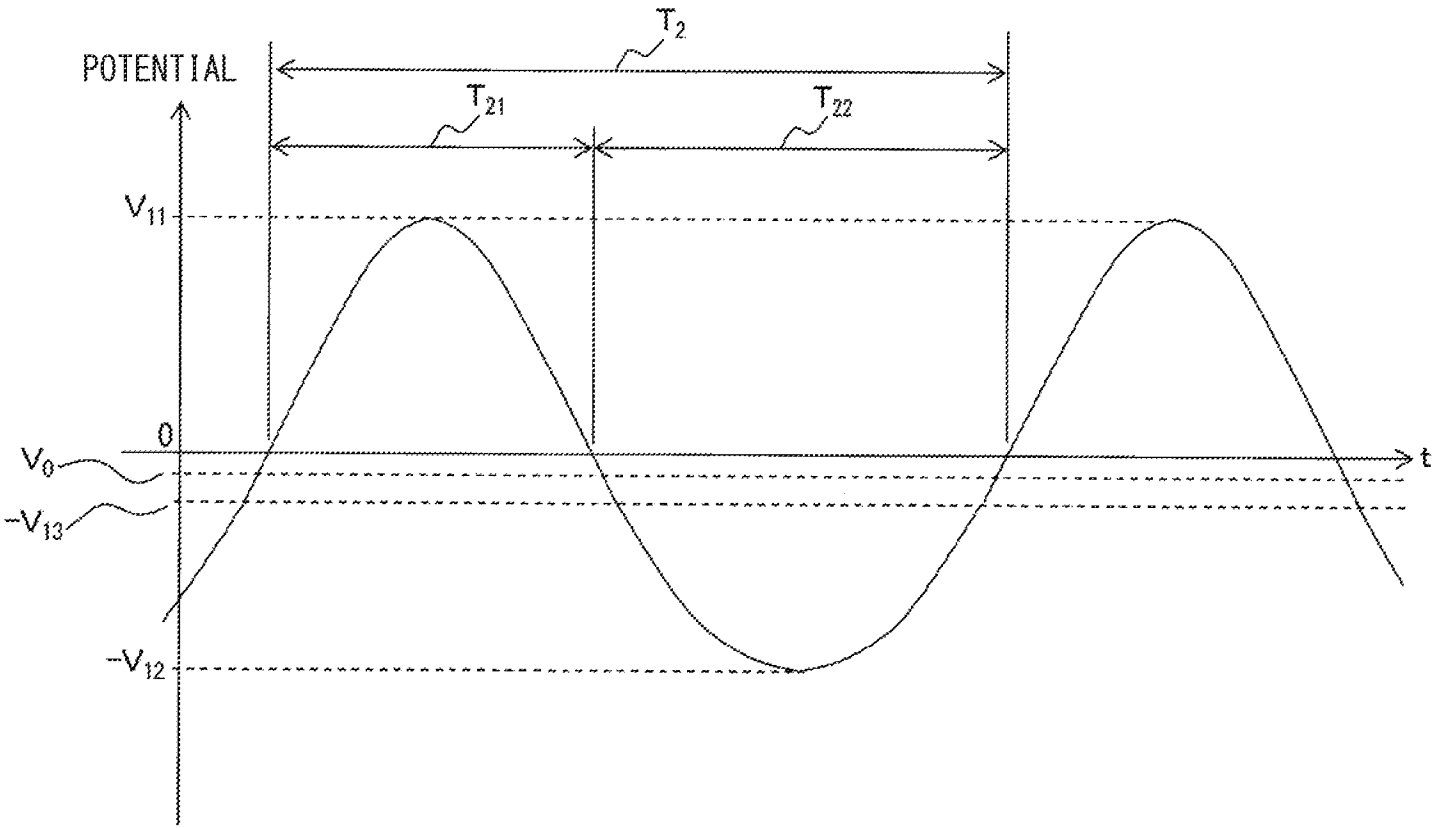
FIG. 11 is a diagram showing an example of drive operations of a discharge electrode 104 in the static eliminator 100 of FIG. 10, showing a potential of the discharge electrode 104.

FIG. 11 is a diagram showing an example of drive operations of the discharge electrode 104 in the static eliminator 100 of FIG. 10, showing a potential of the discharge electrode 104. In the discharge electrode 104, the positive drive voltage and the negative drive voltage are alternately applied in a certain cycle. A maximal value of a potential of the discharge electrode 104 is $V_{11}$, and a minimal value thereof is $-V_{12}$. Further, the application time of the positive drive voltage is $T_{21}$, and the application time of the negative drive voltage is $T_{22}$. A static elimination cycle is $T_2=T_{21}+T_{22}$.

In this example, the DC bias (voltage value is $V_{13}$) is applied such that the average potential $V_0$ is made negative by the DC biasing DC power supply 105. Further, a more negative-side waveform than the reference potential ($-V_{13}$) is distorted by the voltage waveform adjuster circuit 102, and a negative-side amplitude ($V_{12}-V_{13}$) is smaller than a positive-side amplitude ($V_{11}+V_{13}$).

In the static eliminator 100, in order to adjust a ratio between an application time $T_{21}$ of the positive drive voltage and an application time $T_{22}$ of the negative drive voltage while holding the average potential $V_0$ constant, the positive drive voltage (peak value is $V_{11}$) or the negative drive voltage (peak value is $V_{12}$) and the application time of the drive voltage are changed in mutually opposite directions.

For example, in the case of increasing the positive drive voltage or decreasing the negative drive voltage, the application time $T_{21}$ of the positive drive voltage is shortened or the application time $T_{22}$ of the negative drive voltage is lengthened. On the other hand, in the case of decreasing the positive drive voltage or increasing the negative drive voltage, the application time $T_{21}$ of the positive drive voltage is lengthened or the application time $T_{22}$ of the negative drive voltage is shortened.

Also with such a configuration, the ion balance can be held uniform regardless of the distance from the static eliminator 100.

Third Embodiment

In the first embodiment, the example of the case has been described where the present invention is applied to the pulse AC-system static eliminator. As opposed to this, in the present embodiment, a case will be described where the present invention is applied to the pulse DC-system static eliminator and a ratio between an application time of the positive-side drive voltage and an application time of the negative-side drive voltage will be adjusted such that the average potential $V_0$ is held constant.

Figure 12:
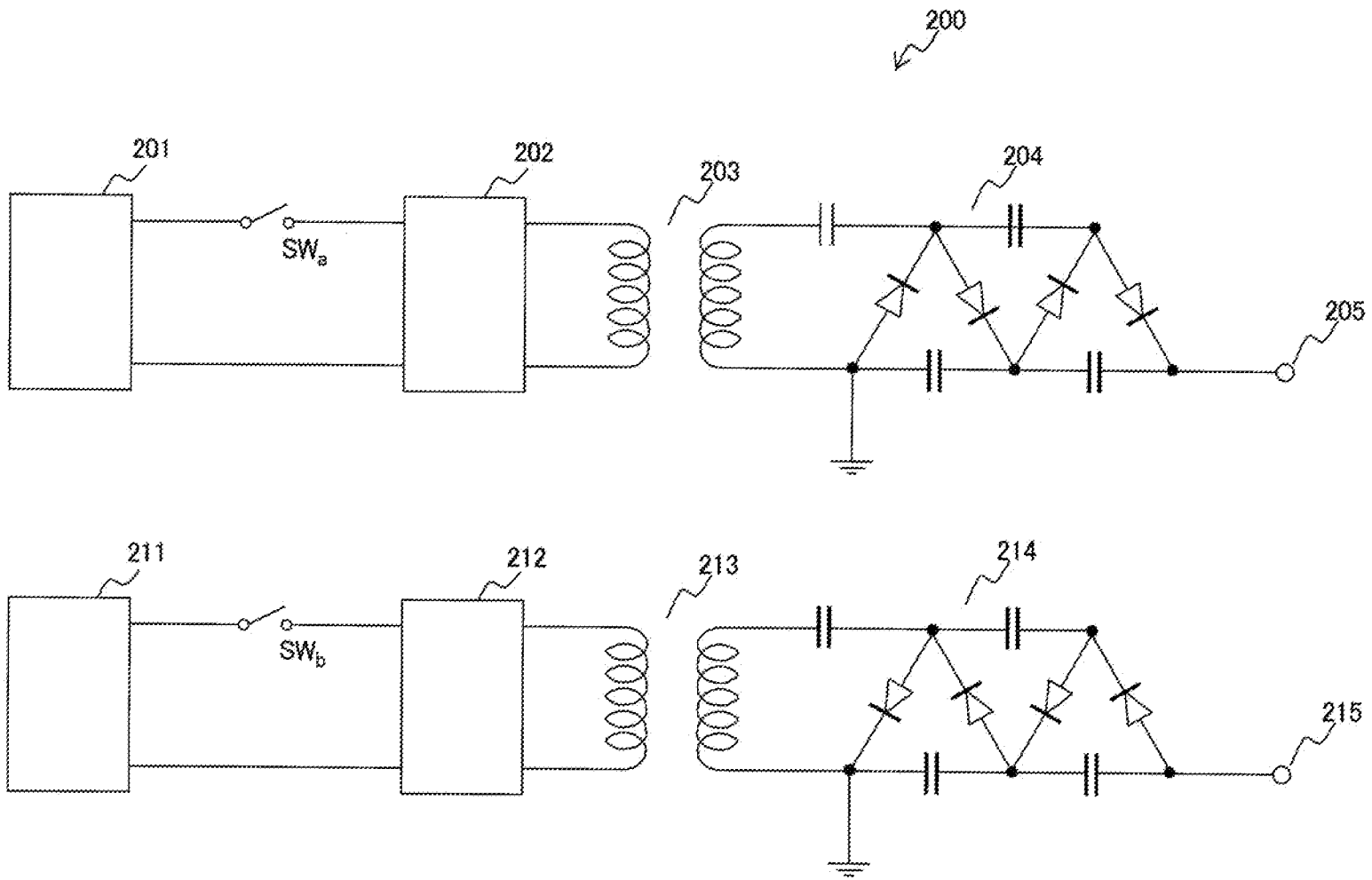
FIG. 12 is a block diagram showing a configuration example of a static eliminator 200 according to a third embodiment of the present invention.

FIG. 12 is a block diagram showing a configuration example of a static eliminator 200 according to a third embodiment of the present invention. The static eliminator 100 is a pulse DC-system static eliminator in which a pulse-like drive voltage is alternately applied to a positive-side electrode 205 and a negative-side electrode 215, and the static eliminator 100 includes DC power supplies 201, 211, oscillator circuits 202, 212, step-up transformers 203, 213, and voltage-doubler rectifier circuits 204, 214.

The DC power supply 201, the oscillator circuit 202, the step-up transformer 203, and the voltage-doubler rectifier circuit 204 are an electrode driving unit for repeatedly applying a positive-side drive voltage va to the discharge electrode 205. The DC power supply 211, the oscillator circuit 212, the step-up transformer 213, and the voltage-doubler rectifier circuit 214 are an electrode driving unit for repeatedly applying a negative-side drive voltage vb to the discharge electrode 215.

A voltage value of the positive-side drive voltage va is controlled by adjustment of an output voltage $v_1$ of the DC power supply 201, and a voltage value of the negative-side drive voltage vb is controlled by adjustment of an output voltage $v_2$ of the DC power supply 211. An application time Ta of the positive electrode side va is controlled by adjustment of on-time of a switching element SWa at the time of alternately and repeatedly turning-on the switching elements SWa, SWb. On the other hand, an application time Tb of the negative-side drive voltage vb is controlled by adjustment of on-time of a switching element SWb.

Figure 13:
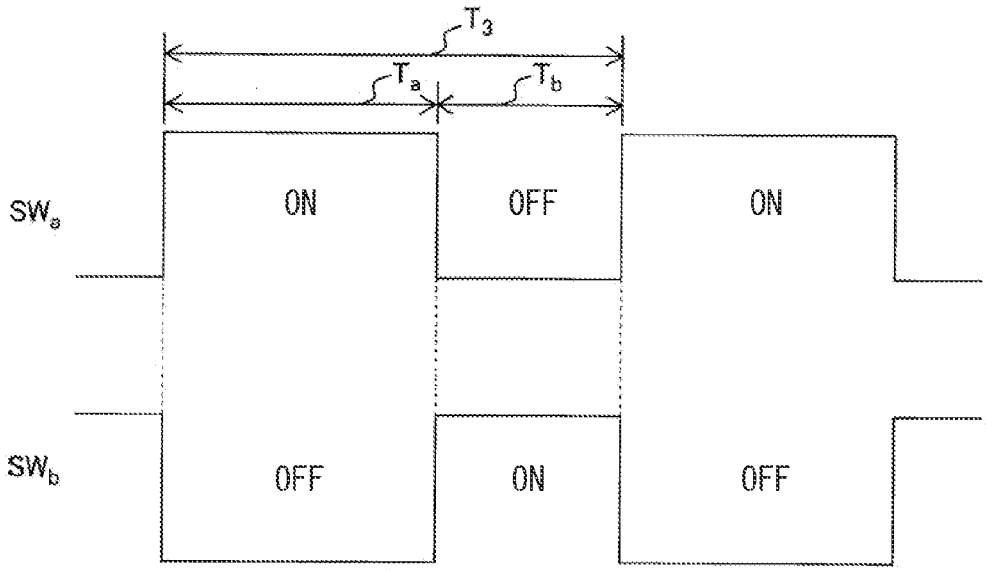
FIG. 13 is a timing chart showing an example of drive operations of discharge electrodes 205, 215 in the static eliminator 200 of FIG. 12.

FIG. 13 is a timing chart showing an example of drive operations of the discharge electrodes 205, 215 in the static eliminator 200 of FIG. 12. An application time Ta of the positive-side drive voltage va and an application time Tb of the negative-side drive voltage vb are respectively controlled by on-time of the switching elements SWa, SWb.

The switching element SWa, SWb are alternately and repeatedly turned on in a cycle $T_3$. The cycle $T_3$ is a static elimination cycle, and expressed by $T_3=Ta+Tb$. In the static eliminator 200, duty ratio $D=Ta/T_3$ is adjusted while the cycle $T_3$ is held constant. At this time, output voltages $v_1$, $v_2$ of the DC power supplies 201, 211 are adjusted so as to hold constant the average potentials $V_0$ of the discharge electrodes 205, 215.

Figure 14:
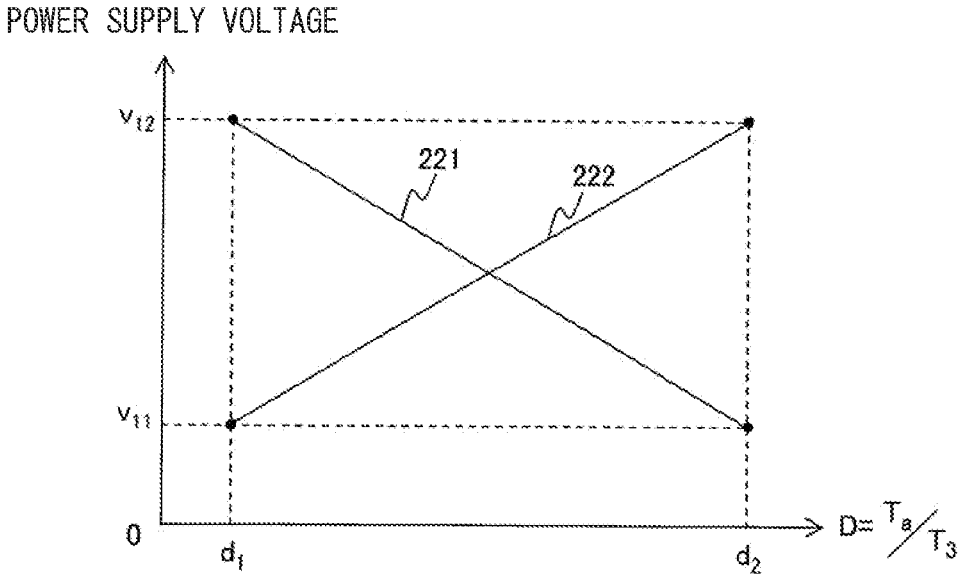
FIG. 14 is a diagram showing an example of voltage tables used in the static eliminator 200 of FIG. 12, showing output voltages $v_1$, $v_2$ corresponding to duty ratio $D=Ta/T_3$.

FIG. 14 is a diagram showing an example of voltage tables used in the static eliminator 200 of FIG. 12, showing output voltages $v_1$, $v_2$ corresponding to duty ratio $D=Ta/T_3$. The output voltage $v_1$ of the DC power supply 201 decreases along a negatively inclined straight line 221 from $v_{12}$ to $v_{11}$ in the range of the duty cycle D being from $d_1$ to $d_2$. On the other hand, the output voltage $v_2$ of the DC power supply 211 increases along a positively inclined straight line 222 from $v_{11}$ to $v_{12}$ in the range of the duty cycle D being from $d_1$ to $d_2$.

In the static eliminator 200, when a voltage table made up of such a voltage value with respect to each duty ratio D is previously held and the duty ratio D is designated from the detected value of the ion balance and the like, an appropriate voltage value corresponding thereto is decided by means of the voltage table.

Figure 15A:
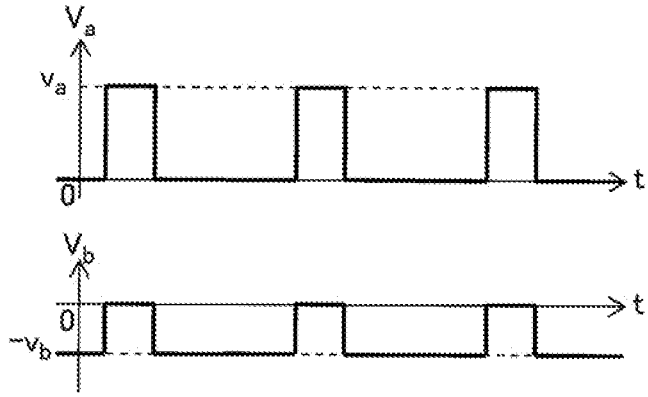
FIGS. 15A to 15C are diagrams each showing an example of drive operations of discharge electrodes 205, 215 in the static eliminator 200 of FIG. 12, showing potentials Va, Vb in the case of different duty ratios D.
Figure 15B:
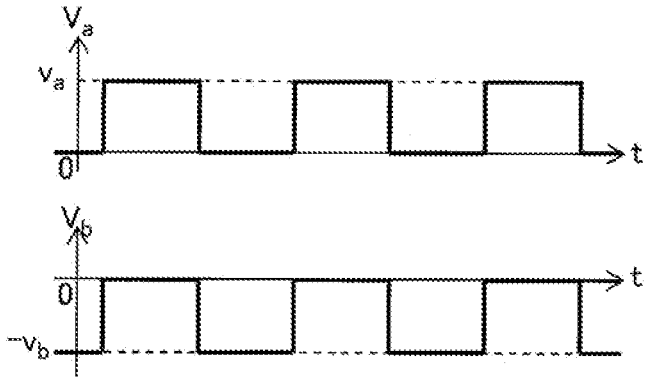
Figure 15C:
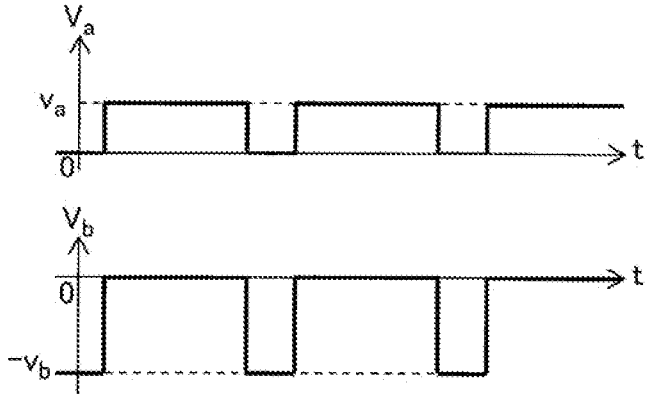

FIGS. 15A to 15C are diagrams each showing an example of the drive operations of discharge electrodes 205, 215 in the static eliminator 200 of FIG. 12, showing potentials Va, Vb in the case of duty ratio $D=Ta/T_3$ being different. FIG. 15A shows the case of Ta<Tb, FIG. 15B shows the case of Ta=Tb, and FIG. 15C shows the case of Ta>Tb.

The potential Va of the discharge electrode 205 is va during the on-period of the switching element SWa, and is 0 during the on-period of the switching element SWa. On the other hand, the potential Vb of the discharge electrode 215 is −vb during the on-period of the switching element SWb, and is 0 during the on-period of the switching element SWa.

In the case of Ta<Tb, the output voltages $v_1$, $v_2$ of the DC power supplies 201, 211 are adjusted such that the application time Ta of the positive-side drive voltage va is shorter and the positive-side drive voltage va is larger than the negative-side drive voltage vb. On the other hand, in the case of Ta>Tb, the output voltages $v_1$, $v_2$ of the DC power supplies 201, 211 are adjusted such that the application time Ta of the positive-side drive voltage va is longer and the positive-side drive voltage va is smaller than the negative-side drive voltage vb.

Also with such a configuration, the ion balance can be held uniform regardless of the distance from the static eliminator 100.

Note that, in the first embodiment, although the example of the case has been described where the output voltage of the discharge electrode 2 is detected based on the current flowing between the secondary ground terminals of the step-up transformers 13, 23 and the ground/earth, the method for detecting an output voltage of the present invention is not limited thereto. For example, such a configuration may be formed where an output voltage is detected by a current flowing through a shunt resistor Rs for discharging charges stored in a parasitic capacitance.

Figure 16A:
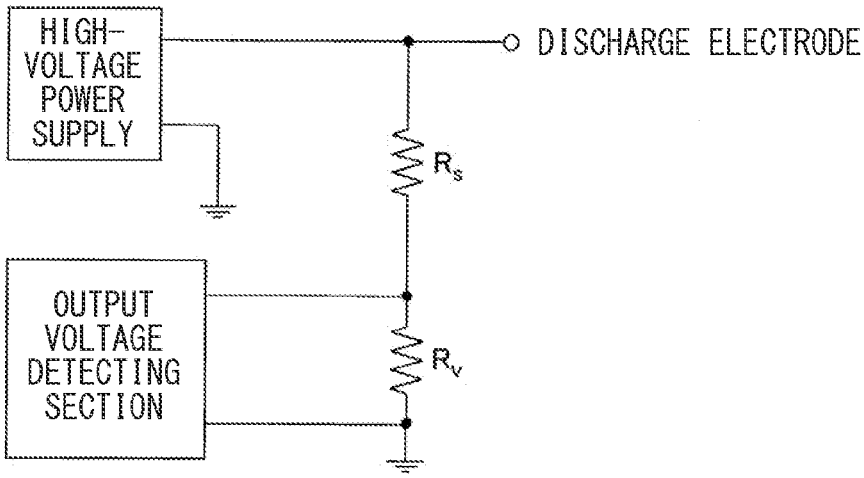
FIGS. 16A and 16B are block diagrams each showing another configuration example of an output voltage detecting section that detects an output voltage of the discharge electrode in the static eliminator according to the present invention.
Figure 16B:
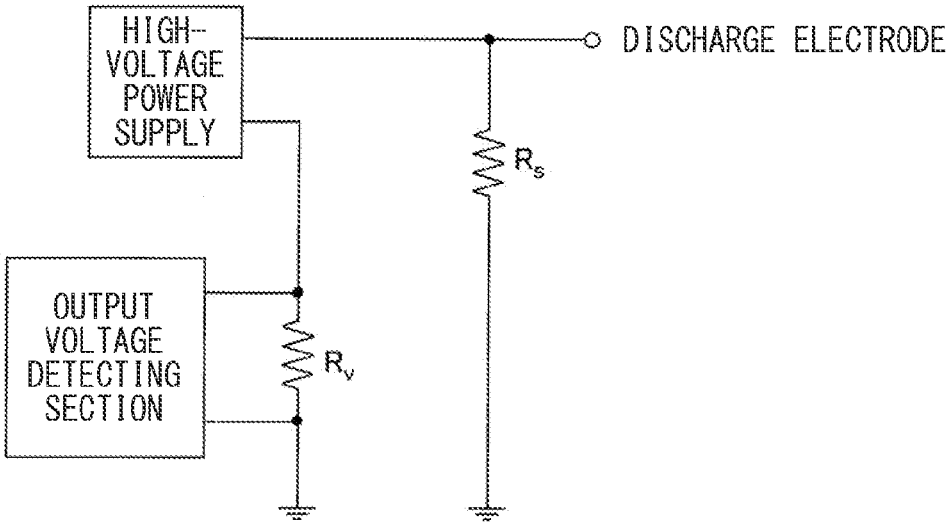

FIGS. 16A and 16B are block diagrams each showing another configuration example of an output voltage detecting section that detects an output voltage of the discharge electrode in the static eliminator according to the present invention. FIG. 16A shows the case of arranging a voltage detecting resistance element Rv between the shunt resistor Rs and the ground/earth. The shunt resistor Rs is a resistor for discharging, to the ground/earth, charges stored in a parasitic capacitance generated between a wire to the discharge electrode and the ground/earth, and is connected with an output terminal of a high-voltage power supply.

The shunt resistor Rs and the resistance element Rv are connected in series, and the output voltage of the discharge electrode is detected by means of a current (shunt current) flowing through the shunt resistor Rs. The detected output voltage is divided into Rs and Rv.

FIG. 16B shows the case of arranging a voltage detecting resistance element Rv between a ground terminal of the high-voltage power supply and the ground/earth. The output voltage of the discharge electrode is detected by a current flowing through the resistance element Rv. Since the current flowing through the resistance element Rv contains the ion current Ii, an error of the output voltage can be made small when the shunt current is sufficiently larger than the ion current Ii.

Fourth Embodiment

In the first to third embodiments, the examples of the case have been described where the drive voltage was repeatedly applied to the discharge electrode in the single cycle. As opposed to this, in the present embodiment, a case will be described where high-frequency drive for generating ions and low-frequency drive for carrying ions are performed.

Figure 17:
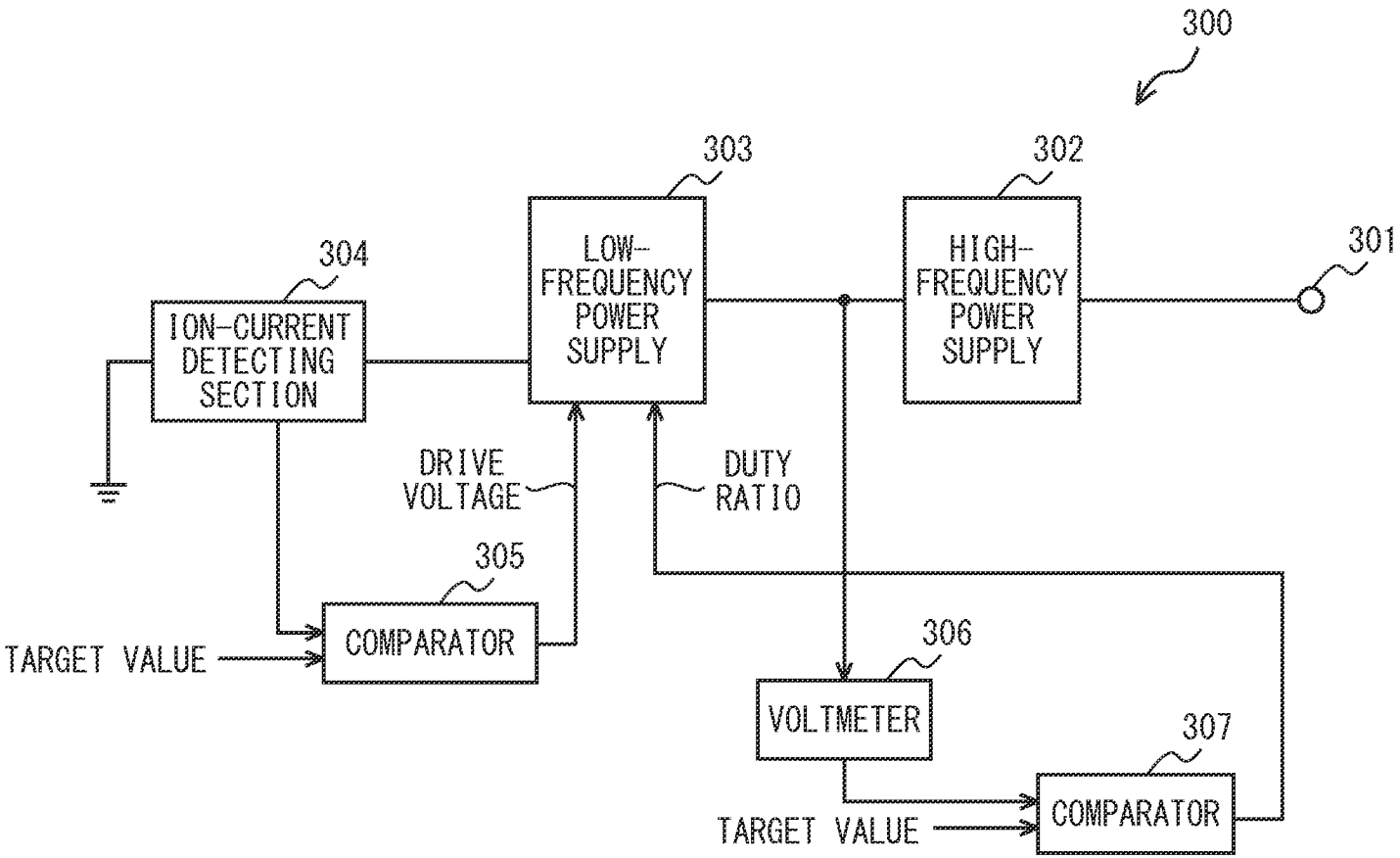
FIG. 17 is a block diagram showing a configuration example of a static eliminator 300 according to a fourth embodiment of the present invention.

FIG. 17 is a block diagram showing a configuration example of a static eliminator 300 according to a fourth embodiment of the present invention. This static eliminator 300 includes a discharge electrode 301, a high-frequency power supply 302, a low-frequency power supply 303, an ion-current detecting section 304, comparators 305, 307, and a voltmeter 306.

The high-frequency power supply 302 outputs a high-frequency voltage for generating positive ions and negative ions, and the low-frequency power supply 303 outputs a low-frequency voltage for carrying the generated ions. Driving the high-frequency power supply 302 by means of the low-frequency voltage supplied from the low-frequency power supply 303 leads to application of the drive voltage, where the low-frequency voltage is superimposed on the high-frequency voltage, to the discharge electrode 301.

The ion-current detecting section 304 detects an ion current flowing through the ground/earth via a ground terminal of the low-frequency power supply 303, to detect ion balance. The comparator 305 compares the ion balance detected by the ion-current detecting section 304 with the target value, and based on the comparison result, the comparator 305 decides a drive voltage and outputs the voltage to the low-frequency power supply 303.

The voltmeter 306 detects an output voltage of the low-frequency power supply 303, to calculate the average potential $V_0$. The comparator 307 compares the average potential $V_0$ calculated by the voltmeter 306 with the target value, and based on the comparison result, the comparator 307 decides a duty ratio of the application time and outputs the ratio to the low-frequency power supply 303.

In the static eliminator 300, the positive-side drive voltage and the negative-side drive voltage of the low-frequency voltage, the application time of the positive-side drive voltage and the application time of the negative-side drive voltage are adjusted, while the average potential $V_0$ is held constant. Also with such a configuration, the ion balance can be held uniform regardless of the distance from the static eliminator 300.

Fifth Embodiment

In the first to third embodiments, the examples of the case have been described where the drive voltage was repeatedly applied to the discharge electrode in the single cycle. As opposed to this, in the present embodiment, a case will be described where a discharge electrode applied with an ion generating high-frequency voltage and a discharge electrode applied with an ion-carrying low-frequency voltage are used.

Figure 18:
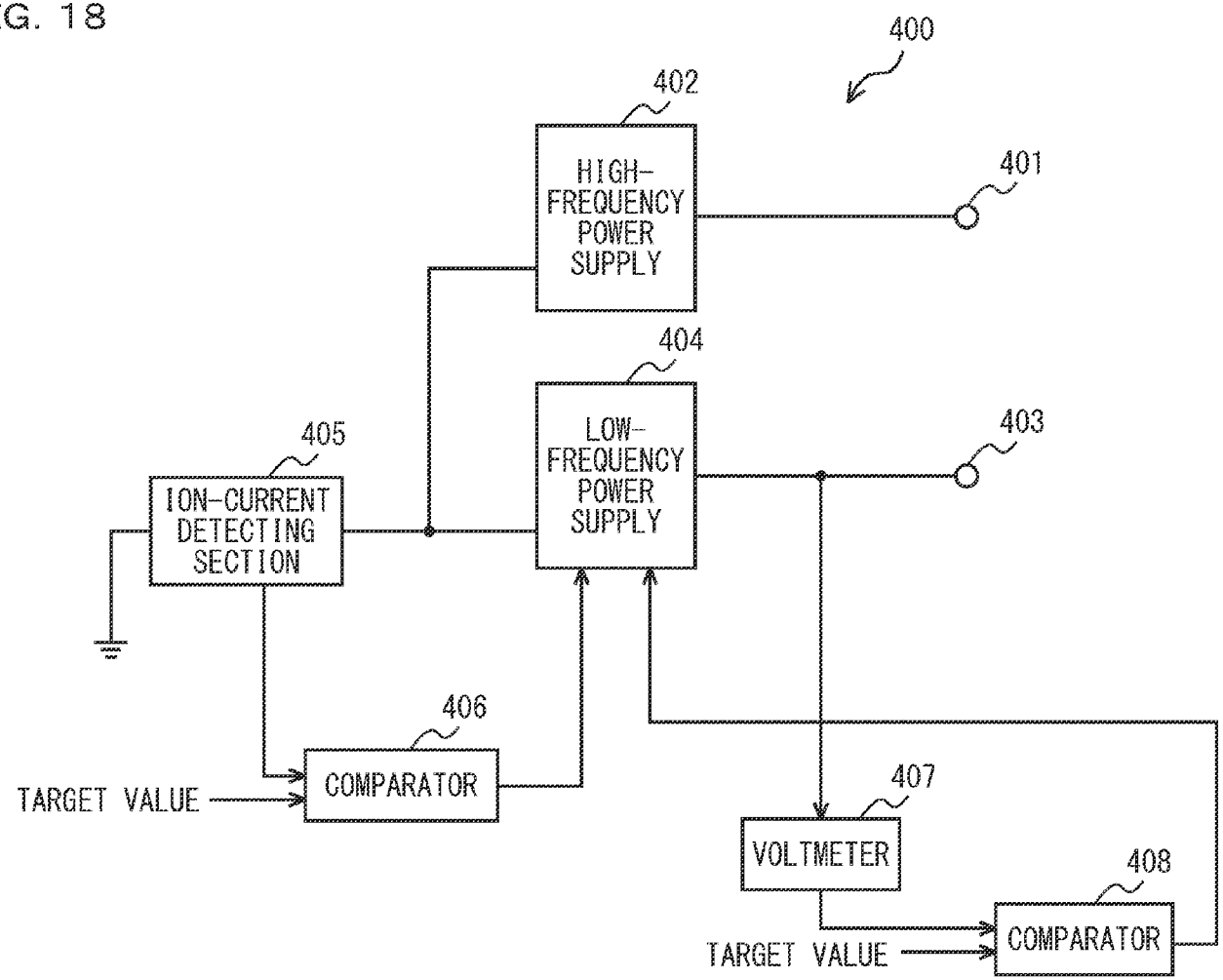
FIG. 18 is a block diagram showing a configuration example of a static eliminator 400 according to a fifth embodiment of the present invention.

FIG. 18 is a block diagram showing a configuration example of a static eliminator 400 according to a fifth embodiment of the present invention. The static eliminator 400 includes an ion-generating discharge electrode 401, a high-frequency power supply 402, an ion-carrying discharge electrode 403, a low-frequency power supply 404, an ion-current detecting section 405, comparators 406, 408, and a voltmeter 407.

The ion-generating discharge electrode 401 is a discharge electrode that is applied with a high-frequency voltage for generating positive ions and negative ions, and is connected to an output terminal of the high-frequency power supply 402. The ion-carrying discharge electrode 403 is a discharge electrode that is applied with a low-frequency voltage for carrying the generated ions, and is connected to an output terminal of the low-frequency power supply 404.

The comparator 406 compares the ion balance detected by the ion-current detecting section 405 with the target value, and based on the comparison result, the comparator 406 decides a drive voltage and outputs the voltage to the low-frequency power supply 404. The comparator 408 compares the average potential $V_0$ calculated by the voltmeter 407 with the target value, and based on the comparison result, the comparator 408 decides a duty ratio of the application time and outputs the ratio to the low-frequency power supply 404.

In the static eliminator 400, the positive-side drive voltage and the negative-side drive voltage of the low-frequency voltage, the application time of the positive-side drive voltage and the application time of the negative-side drive voltage are adjusted, while the average potential $V_0$ is held constant. Also with such a configuration, the ion balance can be held uniform regardless of the distance from the static eliminator 400.

Note that, in the first, fourth, and fifth embodiments, although the examples of the case have been described where the voltage value of the drive voltage is adjusted based on the detected value of the ion balance and the application time of the drive voltage is adjusted based on the detected value of the output voltage, it may be configured such that the application time of the drive voltage is adjusted based on the detected value of ion balance and the voltage value of the drive voltage is adjusted based on the detected value of the output voltage.

Further, in the first, fourth, and fifth embodiments, although the examples of the case have been described where the output voltage of the high-voltage power supply is detected to detect the output voltage of the discharge electrode, it may be configured such that the input voltage of the high-voltage power supply is detected to detect the output voltage. For example, in the case of driving the step-up transformer by the inverter circuit (oscillator circuit), the output voltage of the step-up transformer is proportional to the input voltage of the inverter circuit. Thereat, by measuring the input voltage of the inverter circuit, the output voltage of the discharge electrode can be detected.

Further, in the first embodiment, although the example of the case has been described where duty ratio Ds of application time=$Tn/T_1$ is adjusted while the static elimination cycle $T_1$ is held constant, it may be configured such that the application time of the drive voltage of one of the positive drive voltage and the negative drive voltage is fixed and the application time of the other drive voltage is adjusted.

Moreover, in the first embodiment, the configuration has been described where the positive drive voltage is increased and the negative drive voltage is decreased in the case of increasing the positive ions, and the positive drive voltage is decreased and the negative drive voltage is increased in the case of increasing the negative ions. However, the present invention includes one configured such that the voltage value of one of the drive voltage with the same polarity as ions to be increased and the drive voltage with the reverse polarity is fixed, and the voltage value of the other drive voltage is adjusted.

Note that, in the first, fourth, and fifth embodiments, although the examples of the case have been described where the voltage value and the application time of the drive voltage are automatically adjusted in accordance with the detected value of the ion balance, the present invention is not limited to one that detects the ion balance to automatically adjust the drive parameters of the voltage value, the application time, and the like. For example, the present invention may be configured such that, when a user's operation is detected and the user designates relatively increasing the positive ions or relatively increasing the negative ions, the voltage value of the drive voltage with the same polarity as ions to be increased is increased, and also the ratio of the application time of that drive voltage is decreased. Further, the present invention may be configured such that the user is made to select between a manual control mode based on such a user's operation and an automatic control mode based on the detected value of the ion balance.

What is claimed is:

1. A static eliminator, comprising:

an electrode driving circuit capable of alternately and repeatedly applying, to a discharge electrode, a positive drive voltage and a negative drive voltage as drive voltages so as to output a positive ion and a negative ion from the discharge electrode for corona discharge;

a drive controlling device configured to relatively decrease an application time of the positive drive voltage relative to an application time of the negative drive voltage while relatively increasing an amplitude of the positive drive voltage relative to an amplitude of the negative drive voltage so as to relatively increase outputting of the positive ion relative to the negative ion, and to relatively increase the application time of the positive drive voltage relative to the application time of the negative drive voltage while relatively decreasing the amplitude of the positive drive voltage relative to the amplitude of the negative drive voltage so as to relatively increase outputting of the negative ion relative to the positive ion.

2. The static eliminator according to claim 1, comprising an ion balance detecting device that detects ion balance between positive ions and negative ions in a periphery of the discharge electrode, wherein the drive controlling device determines whether the outputting of the positive ion should be relatively increased or the outputting of the negative ion based on the detected ion balance.

3. The static eliminator according to claim 2, comprising:

a target value storing device configured to store a first target value of the ion balance and a second target value of the average potential; and a detector configured to detect an ion balance, the positive drive voltage and the negative drive voltage, wherein the drive controlling device relatively increases or decreases the amplitude of the positive drive voltage repeatedly until the ion balance matches the first target value, and after the detected ion balance matches the first target value, the drive controlling device relatively increases or decreases the application time of the positive drive voltage such that the average potential obtained from the detected positive drive voltage and the detected negative drive voltage matches with the second target value.

4. The static eliminator according to claim 3, wherein the detector detects the ion balance based on a current flowing between a ground electrode and a ground/earth, and the positive drive voltage and the negative drive voltage based on a current flowing between a secondary ground terminal of a step-up transformer and the ground/earth.

5. A static elimination control method, comprising:

alternately and repeatedly applying, to a discharge electrode, a positive drive voltage and a negative drive voltage so as to output a positive ion and a negative ion from the discharge electrode for corona discharge;

relatively decreasing an application time of the positive drive voltage and relative to an application time of the negative drive voltage while relatively increasing an amplitude of the positive drive voltage relative to an amplitude of the negative drive voltage so as to relatively increase outputting of the positive ion relative to the negative ion; and relatively increasing the application time of the positive drive voltage relative to the application time of the negative drive voltage while relatively decreasing the amplitude of the positive drive voltage relative to the amplitude of the negative drive voltage so as to relatively increase outputting of the negative ion relative to the positive ion.

* * * * *

UNITED STATES PATENT AND TRADEMARK OFFICE

CERTIFICATE OF CORRECTION

PATENT NO. : 8,587,917 B2
APPLICATION NO. : 13/438204
DATED : November 19, 2013
INVENTOR(S) : Tsukasa Fujita It is certified that error appears in the above-identified patent and that said Letters Patent is hereby corrected as shown below:

IN THE CLAIMS:

Claim 5, Column 18, Line 44, “drive voltage and relative” should read --drive voltage relative--.

Signed and Sealed this
Thirty-first Day of December, 2013

Margaret A. Focarino

Margaret A. Focarino
*Commissioner for Patents of the United States Patent and Trademark Office*